US005718406A

United States Patent [19]

Long

[11] Patent Number: 5,718,406

[45] Date of Patent: Feb. 17, 1998

[54] COUNTERBALANCE APPARATUS

[76] Inventor: Dennis L. Long, 2161 Thornapple Dr., Grand Rapids, Mich. 49546

[21] Appl. No.: 584,266

[22] Filed: Jan. 11, 1996

[51] Int. Cl.[6] ..... A47B 9/02; A47B 9/20; A47B 9/10; A47B 9/14

[52] U.S. Cl. ..... 248/600; 248/623; 248/624; 248/162.1; 108/144; 108/148; 267/34; 267/140.4

[58] Field of Search ..... 248/123.11, 162.1, 248/404, 188.5, 364, 622, 623, 624, 600; 108/148, 146, 144; 267/195, 221, 34, 287, 140.4, 177

[56] References Cited

U.S. PATENT DOCUMENTS

| | | | |
|---|---|---|---|
| 300,887 | 6/1884 | Owen | 108/144 |
| 424,711 | 4/1890 | Homan | 248/600 X |
| 484,707 | 10/1892 | Garee . | |
| 660,868 | 10/1900 | Reid | 248/162.1 X |
| 2,649,345 | 8/1953 | Hubbard . | |
| 2,918,273 | 12/1959 | Whisler et al. | 267/34 |
| 3,543,282 | 11/1970 | Sautereau . | |
| 3,582,059 | 6/1971 | Van Ooy | 267/34 |
| 3,845,926 | 11/1974 | Wahls | 248/162.1 |
| 3,885,764 | 5/1975 | Pabreza | 248/162.1 |
| 4,130,069 | 12/1978 | Evans et al. | 108/136 |
| 4,156,391 | 5/1979 | Ubezio | 248/162.1 X |
| 4,183,689 | 1/1980 | Wirges et al. . | |
| 4,351,245 | 9/1982 | Laporte | 108/136 |
| 4,381,714 | 5/1983 | Henneberg et al. | 108/147 |
| 4,415,135 | 11/1983 | French | 248/162.1 X |
| 4,619,208 | 10/1986 | Kurrasch | 108/144 |
| 4,625,657 | 12/1986 | Little et al. | 108/148 X |
| 4,651,652 | 3/1987 | Wyckoff | 108/144 |
| 5,243,921 | 9/1993 | Kruse et al. . | |
| 5,311,827 | 5/1994 | Greene | 108/147 |
| 5,322,025 | 6/1994 | Sherman et al. | 108/147 |
| 5,400,721 | 3/1995 | Greene | 108/147 |
| 5,443,017 | 8/1995 | Wacker et al. | 108/3 |
| 5,456,191 | 10/1995 | Hall | 108/147 |
| 5,513,825 | 5/1996 | Gutgsell | 108/144 X |

FOREIGN PATENT DOCUMENTS

| | | | |
|---|---|---|---|
| 281884 | 12/1927 | United Kingdom | 108/144 |

*Primary Examiner*—Robert W. Gibson, Jr.
*Assistant Examiner*—Stephen S. Wentsler
*Attorney, Agent, or Firm*—Ian C. McLeod; Mary M. Moyne

[57] ABSTRACT

A counterbalance apparatus (10) for moving the work surface (100B) of a work station (100) is described. Preferably, the apparatus includes first and inner tubular members (12 and 20), a spring (70) and a cam follower (50). The first member is mounted to the panel (100A) adjacent the work station. The inner member is mounted with the top end (20A) adjacent the underside of the work surface and the bottom end (20B) extending into the top end (12A) of the first member. The sidewalls (12C and 20C) of the first and inner members have first and inner cam grooves (16 and 26), respectively. A dampener (30) is preferably mounted within the inner member. A threaded rod 36 is mounted on the top end (32A) of the body (32) of the dampener and has an adjustment head (36B) which extends through the work surface. The cam follower having rollers (56 and 58) is mounted at the bottom end (34A) of the piston rod (34) of the dampener such that the rollers extend into the first and inner cam grooves, respectively. The spring is mounted between the cam follower and an adjustment nut (44) around the threaded rod. During movement of the work surface, the inner member moves in and out of the first member to compress and expand the spring. The cam rollers move along the cam grooves and allow for a constant force on the work station through out the movement of the work station.

32 Claims, 12 Drawing Sheets

100C
100
A
222
100B
102
100
9
220D
9
246
242
236
100A
220
220A
220C
210
230
232
270
234
212D
226
100A
234A
260
250
10
220E
212C
10
212A
212
216
A

102

100C
100B
222
220D
220
210
230
270
216
260
250
226
212
212A
220E

COUNTERBALANCE APPARATUS

BACKGROUND OF THE INVENTION (1) Field of the Invention

The present invention relates to a counterbalance apparatus for use in moving a work surface. In particular, the present invention relates to a preferred counterbalance apparatus for vertically moving the work surface of a work station where the counterbalance apparatus exerts a constant force on the moving work surface.

(2) Description of the Related Art

The related art has shown various systems and mechanisms for vertically adjusting work surfaces or table tops. Illustrative are U.S. Pat. No. 484,707 to Garee; U.S. Pat. No. 2,649,345 to Hubbard; U.S. Pat. No. 4,130,069 to Evans et al; U.S. Pat. No. 4,183,689 to Wirges et al; U.S. Pat. No. 4,381,714 to Henneberg et al; U.S. Pat. No. 4,619,208 to Kurrasch; U.S. Pat. No. 4,651,652 to Wyckoff; U.S. Pat. No. 5,243,921 to Kruse et al; U.S. Pat. No. 5,322,025 to Sherman et al; U.S. Pat. No. 5,443,017 to Wacker et al and U.S. Pat. No. 5,456,191 to Hall.

In addition, U.S. Pat. Nos. 5,400,721 and 5,311,827 both to Greene show a load compensator for a spring counterweight mechanism which includes a snail cam.

U.S. Pat. No. 4,351,245 to Laporte describes a counterweight system which uses cables and pulleys in combination with a cam mechanism. Similarly, U.S. Pat. No. 3,543,282 to Sautereau describes a drawing board having a counterbalance mechanism which includes pulleys and cables and which allows for easier vertical movement of the drawing board.

There remains the need for a counterbalance mechanism which allows for vertical movement of the table top or work surface at a constant rate by application of a constant force and which is easily installed into an existing table or work station.

OBJECTS

It is therefore an object of the present invention to provide a counterbalance apparatus which allows for vertical movement of a table top or work surface at a constant rate using a constant force. Further, it is an object of the present invention to provide a method for vertically moving the top of a table or the work surface of a work station at a constant rate using a constant force. Still further, it is an object of the present invention to provide a counterbalance apparatus which allows for adjustment of the initial preload on the apparatus to compensate for the change in load on the table top or work surface without changing the amount of force needed to move the table top. Further still, it is an object of the present invention to provide a counterbalance apparatus which is easily and quickly installed into an existing table or work station. Further, it is an object of the present invention to provide a counterbalance apparatus which is inexpensive to manufacture.

These and other objects will become increasingly apparent by reference to the following drawings and the description.

DETAILED DESCRIPTION OF THE PREFERRED EMBODIMENT

Figure 1:
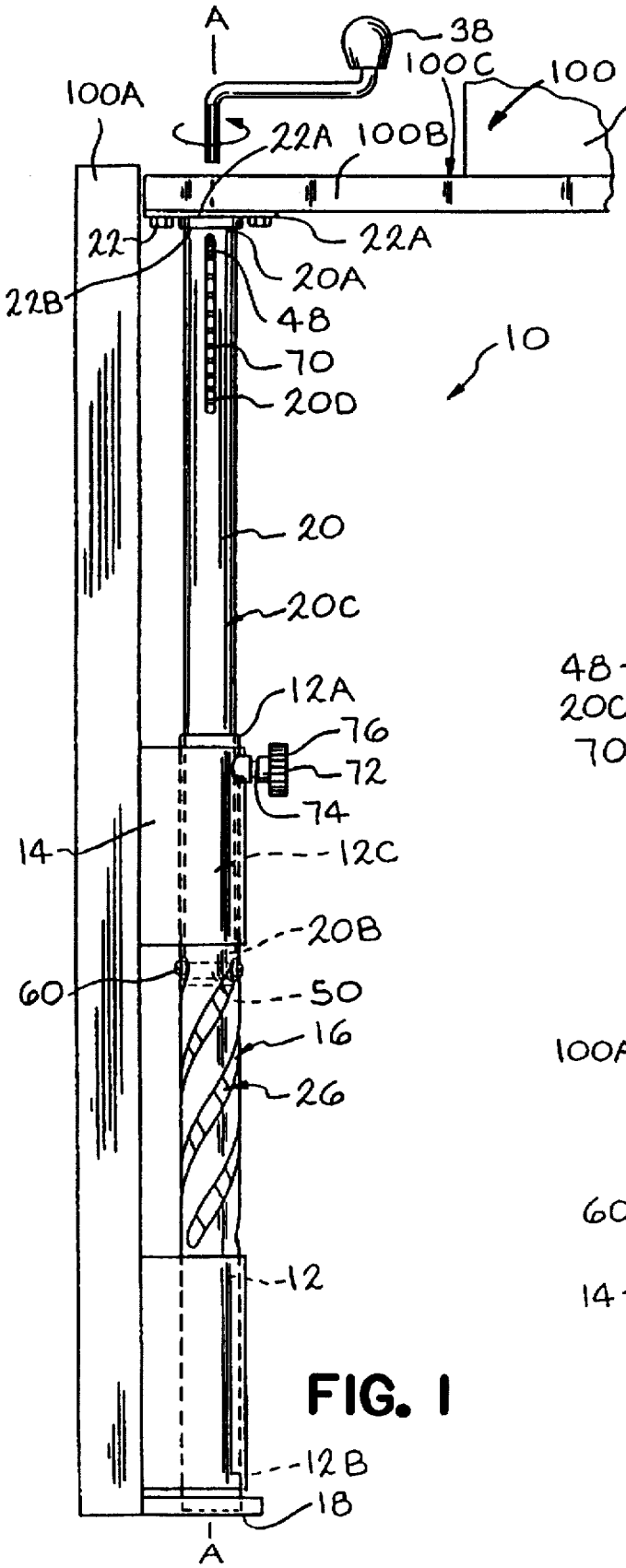
FIG. 1 is a side view of the counterbalance apparatus 10 mounted on a work station 100 with the work surface 100B in the fully raised position.

The present invention relates to a counterbalance apparatus, the improvement which comprises a first member defining a longitudinal axis and having a first end and a second end with at least one wall between the ends which forms the member; a second member slidably mounted on the first member so as to be along the axis and having a first end and a second end with at least one wall between the ends; first and second cam means, one for the first member and one for the second member, mounted between the second member and the first member, wherein the first and second cam means have cam surfaces which define oppositely inclined paths and cam followers which move in the oppositely inclined paths with respect to the longitudinal axis and wherein at least one of the second member or first member is movable along the longitudinal axis relative to the other of the members to move the members together; and resilient means with opposed ends which are mounted between the second member and the first member so as to bias the members apart and wherein the resilient means becomes shorter in length between the ends when the members are moved together.

Further, the present invention relates to a counterbalance apparatus, the improvement which comprises a first tubular member defining a longitudinal axis and having a first end and a second end with at least one wall between the ends which forms the tubular member, wherein a first cam surface is provided on the wall and is inclined with respect to the longitudinal axis of the first tubular member; a second tubular member slidably mounted in the first tubular member so as to be along the axis and having a first end and a second end and at least one wall between the ends, wherein a second cam surface is provided on the wall of the second tubular member along the axis and is inclined with respect to the longitudinal axis of the first tubular member, wherein the first and second cam surfaces are oppositely inclined with respect to the longitudinal axis and wherein at least one of the second or first tubular members is movable along the longitudinal axis relative to the other of the tubular members to move the tubular members together; cam follower means mounted on and between the first and second cam surfaces, wherein the cam follower means moves on both cam surfaces simultaneously as the tubular members are moved together; and resilient means with opposed ends which is mounted along and around the longitudinal axis of the tubular members so as to bias the tubular members apart and wherein the resilient means is shortened in length between the ends when the tubular members are moved together.

Still further, the present invention relates to a table with a counterbalance vertically movable tube and a support means for the top of the table with a counterbalance apparatus between the support means and the top of the table for the movement which comprises the counterbalance apparatus including a first member defining a longitudinal axis and having a first end and a second end with at least one wall between the ends which forms the member; a second member slidably mounted on the first member so as to be along the axis and having a first end and a second end with at least one wall between the ends; first and second cam means, one for the first member and one for the second member, mounted between the second member and the first member, wherein the first and second cam means have cam surfaces which define oppositely inclined paths and cam followers which move in the oppositely inclined paths with respect to the longitudinal axis and wherein at least one of the second member or first member is movable along the longitudinal axis relative to the other of the members to move the members together; and resilient means with opposed ends which are mounted between the second member and the first member so as to bias the members apart and wherein the resilient means becomes shorter in length between the ends when the members are moved together; and locking means for securing the second and first members and thus the top of the table against movement.

Further, the present invention relates to a table with a counterbalance vertically movable top and a support means for the top with a counterbalance apparatus between the support means and the top for the movement which comprises, the counterbalance apparatus including an first tubular member defining a longitudinal axis and having a first end and a second end with at least one wall between the ends which forms the tubular member, wherein a first cam surface is provided on the wall and is inclined with respect to the longitudinal axis of the first tubular member; a second tubular member slidably mounted in the first tubular member so as to be along the axis and having a first end and a second end and at least one wall between the ends, wherein a second cam surface is provided on the wall along the axis and is inclined with respect to the longitudinal axis of the first tubular member, wherein the first and second cam surfaces are oppositely inclined with respect to the longitudinal axis and wherein at least one of the second or first tubular members is movable along the longitudinal axis relative to the other of the tubular members to move the tubular members together; cam follower means mounted on and between the first and second cam surfaces, wherein the cam follower means moves on both cam surfaces simultaneously as the tubular members are moved together; and resilient means with opposed ends which are mounted along and around the longitudinal axis of the first tubular member so as to bias the tubular members apart and which is shortened in length between the ends of the resilient means when the tubular members are moved together; and locking means for securing the second and first tubular members and thus the top of the table against movement.

Still further, the present invention relates to a counterbalance apparatus, the improvement which comprises: a first member defining a longitudinal axis and having a first end and a second end with at least one wall between the ends which forms the member; a second member slidably mounted on the first member so as to be along the axis and having a first end and a second end with at least one wall between the ends; first and second cam, one for the first member and one for the second member, mounted between the second member and the first member, wherein the first and second cam have cam surfaces which define oppositely inclined paths and cam followers which move in the oppositely inclined paths with respect to the longitudinal axis and wherein at least one of the second member or first member is movable along the longitudinal axis relative to the other of the members to move the members together; and force storage mechanism with opposed ends which is mounted between the second member and the first member so as to bias the members apart.

Further, the present invention relates to a counterbalance apparatus, the improvement which comprises: a first tubular member defining a longitudinal axis and having a first end and a second end with at least one wall between the ends which forms the tubular member, wherein a first cam surface is provided on the wall and is inclined with respect to the longitudinal axis of the first tubular member; a second tubular member slidably mounted in the first tubular member so as to be along the axis and having a first end and a second end and at least one wall between the ends, wherein a second cam surface is provided on the wall of the second tubular member along the axis and is inclined with respect to the longitudinal axis of the first tubular member, wherein the first and second cam surfaces are oppositely inclined with respect to the longitudinal axis and wherein at least one of the second or first tubular members is movable along the longitudinal axis relative to the other of the tubular members to move the tubular members together; cam follower mounted on and between the first and second cam surfaces, wherein the cam follower moves on both cam surfaces simultaneously as the tubular members are moved together; and force storage mechanism with opposed ends which is mounted along and around the longitudinal axis of the tubular members so as to bias the tubular members apart.

The members of the apparatus can have a variety of cross-sectional shapes such as circular or rectangular. The apparatus can also be provided with a dampener which increases the safety of the device by preventing accelerated movement of the object or work surface if the load on the surface or weight of the object is changed. The apparatus preferably has an adjustment head which allows for adjusting the apparatus for the exact weight of the work surface or object to be moved. This adjustment is preferably accomplished by adjusting the preload force on the spring or other force storage mechanism which for a spring is achieved by changing the initial amount of compression of the spring.

The counterbalance apparatus has a variety of uses which include vertically raising the top of a table, the work surface of a work station, an object or in a plant to raise and lower loads. The apparatus could be used to raise and lower camper tops and could also be used to raise and lower garage doors. The apparatus can also be used to move objects or work surfaces in other directions besides vertically. The apparatus allows surfaces or objects having some weight to be easily moved without needing to apply a large force. The apparatus could be used to move a surface horizontally toward or away from a stationary object such as a wall. The apparatus can be used anywhere where it is necessary to move a heavy object using minimal force. The apparatus creates a state of equilibrium where the force acting on the work surface or object is equal to the force exerted by the work surface or object on the apparatus thus, allowing heavy objects to be easily and safely moved.

Figure 2:
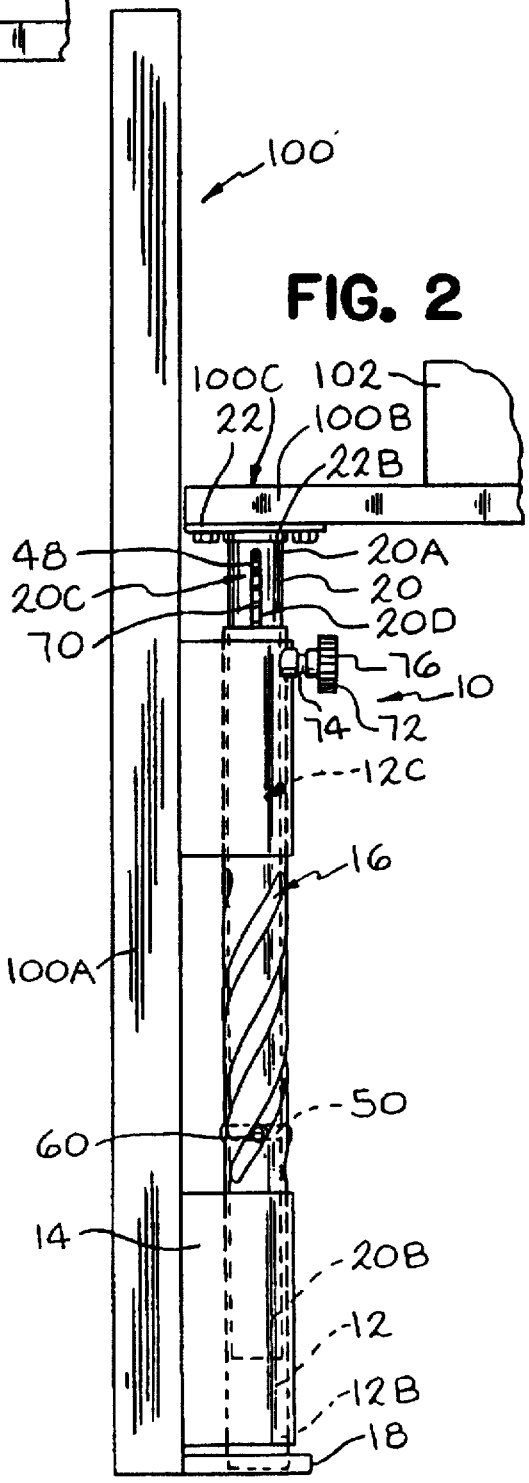
FIG. 2 is a side view of the counterbalance apparatus 10 of FIG. 1 with the work surface 100B in a lowered position.

FIGS. 1 to 6 show the counterbalance or counterweight apparatus 10 of the present invention for raising or lowering the work surface 100B of a work station 100 or the top of a table (not shown). Preferably, having a load 102 such as a computer or typewriter, etc. The apparatus 10 includes an outer tubular member 12, an inner tubular member 20, a dampener 30, a force storage mechanism such as a spring 70 and a cam follower 50. The outer tubular member 12 preferably has a hollow, cylindrical shape with opposed open ends 12A and 12B and a sidewall 12C therebetween. The member 12 is mounted on its outside surface to a panel 100A adjacent a work surface 100B or a support or base of a table. The outer tubular member 12 may be mounted by any suitable means such as by a pair of clip brackets 14. The clip brackets 14 are mounted on the panel 100A of the work station 100 and extend around the sidewall 12C of the outer tubular member 12 and allow the outer tubular member 12 to be easily mounted between the end caps 18 and 22 adjacent the panel 100A. In an alternate embodiment, not shown, the apparatus 10 is mounted between telescoping legs of a table and is mounted to both of the legs by brackets. Outer cam grooves 16 are provided around the sidewall 12C of the outer tubular member 12, spaced between the ends 12A and 12B of the member 12. The cam grooves 16 are preferably orientated in a spiral configuration at a uniform angle around the outer circumference of the outer tubular member 12 such that the slope of the curve is linear. In the first embodiment, there are three (3) cam grooves 16 which are preferably identical and are spaced about 120° apart around the sidewall 12C of the member 12. The cam grooves 16 preferably have a width of 0.5 inches (1.3 cm) however, the width of the cam grooves 16 is dependent on the size of the cam rollers 58 (to be described in detail hereinafter). The outer tubular member 12 is mounted to the panel 100A such that the outer cam grooves 16 in the sidewall 12C of the outer tubular member 12 are unobstructed and the outer cam roller 58 of the cam follower 50 is able to freely move, completely around the circumference of the outer tubular member 12 in the outer cam grooves 16 (FIGS. 1 and 2).

A cap 18 is preferably mounted on the panel 100A at the open bottom end 12B of the outer tubular member 12. The cap 18 allows for easier removal of the apparatus 10 from the work station 100. The first end cap 18 is preferably mounted over the bottom end 12B of the outer tubular member 12 and is similar to the inner end cap 22 which is mounted on the top end 20A of the inner tubular member 20.

Figure 4:
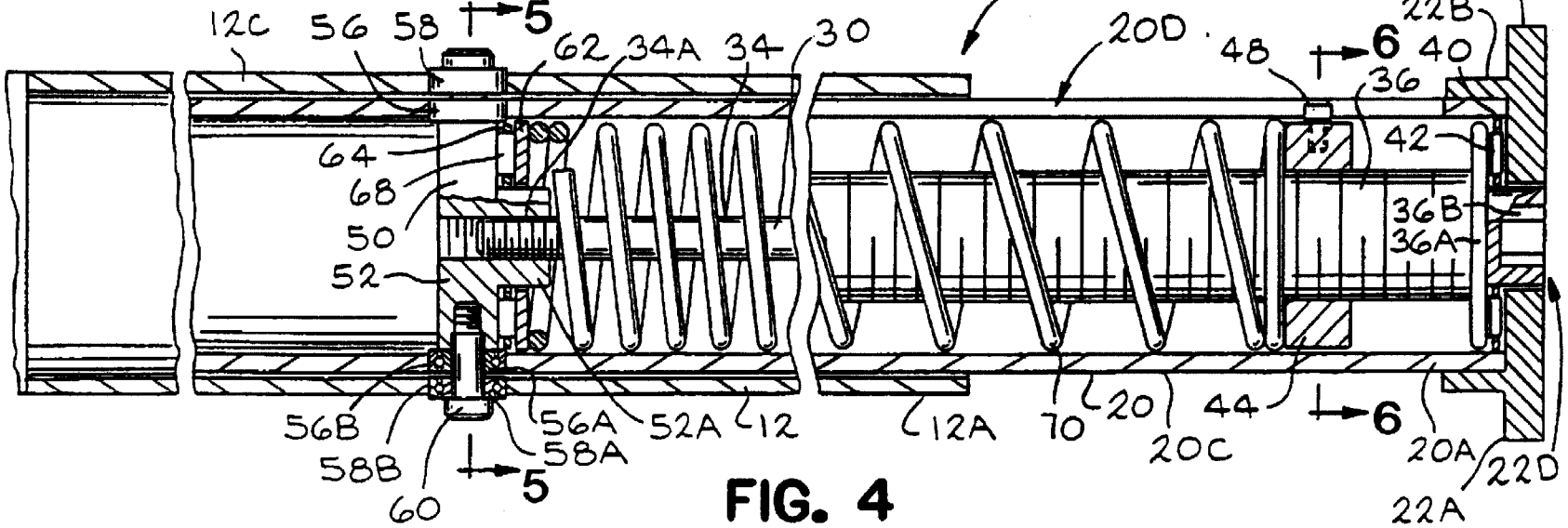
FIG. 4 is a longitudinal, cross-sectional view of the counterbalance apparatus 10 showing the inner tubular member 20 telescoped into the outer tubular member 12 with the spring 70 mounted around the dampener 30.

The inner tubular member 20 preferably has a hollow, cylindrical shape with spaced apart, opposed, ends 20A and 20B having a sidewall 20C therebetween. The inner tubular member 20 is telescopically mounted in the open top end 12A of the outer tubular member 12 such that the bottom end 20B of the inner member 20 extends into the top end 12A of the outer tubular member 12. The top end 20A of the member 20 is preferably closed and takes the thrust of the spring 70. The closed top end 20A of the inner member 20 has an opening to allow the adjustment head 36B to extend up through the work surface 100B (to be described in detail hereinafter) which is releasably mounted by an end cap 22 on the underneath side of the work surface 100B. The end cap 22 includes a top plate 22A with an extension 22B. The extension 22B extends over the outside of the top end 20A of the member 20 (FIG. 4). The top end 20A of the member 20 has a pin 20E which extends into a cap lock slot 22C in the extension 22B of the end cap 22. The top plate 22A of the cap 22 is mounted on the underneath side of the work surface 100B and securely holds the apparatus 10 in contact with the work surface 100B. The cap 22 allows for quick and easy disconnection of the inner tubular member 20 from the work surface 100B. The top plate 22A of the cap 22 inside the extension 22B has a hole 22D (FIG. 4) which allows for extension of an adjustment head 36B through the cap 22 and through an opening (not shown) in the work surface 100B (to be described in detail hereinafter). The inner cam grooves 26 in the sidewall 20C are preferably adjacent the bottom end 20B of the member 20. There are preferably three (3) inner cam grooves 26 which have a width similar to the outer cam grooves 16 of the outer tubular member 12. The inner cam grooves 26 extend around the inner tubular member 20 in an essentially spiral orientation. However, the inner cam grooves 26 preferably do not have a uniform angle. The exact angle and spacing of the inner cam grooves 26 is dependent upon the spring 70 (to be described in detail hereinafter). The inner tubular member 20 has a locking slot 20D adjacent the top end 20A which receives a locking pin 48 mounted on a adjustment nut 44 (to be described in detail hereinafter). The inner tubular member 20 preferably has a length similar to the length of the outer tubular member 12 and has an outer diameter slightly less than the inner diameter of the outer tubular member 12. In the first embodiment, the outer and inner tubular members 12 and 20 preferably have a length of 23.0 inches (58.44 cm). The outer tubular member 12 preferably has an inner diameter of 1.5 inches (3.8 cm) and the inner diameter of the inner tubular member 20 is about 1.3 inches (3.2 cm). Both of the tubular members 12 and 20 are preferably constructed of 11 gauge steel. However, any rigid, durable material could be used.

Figure 3:
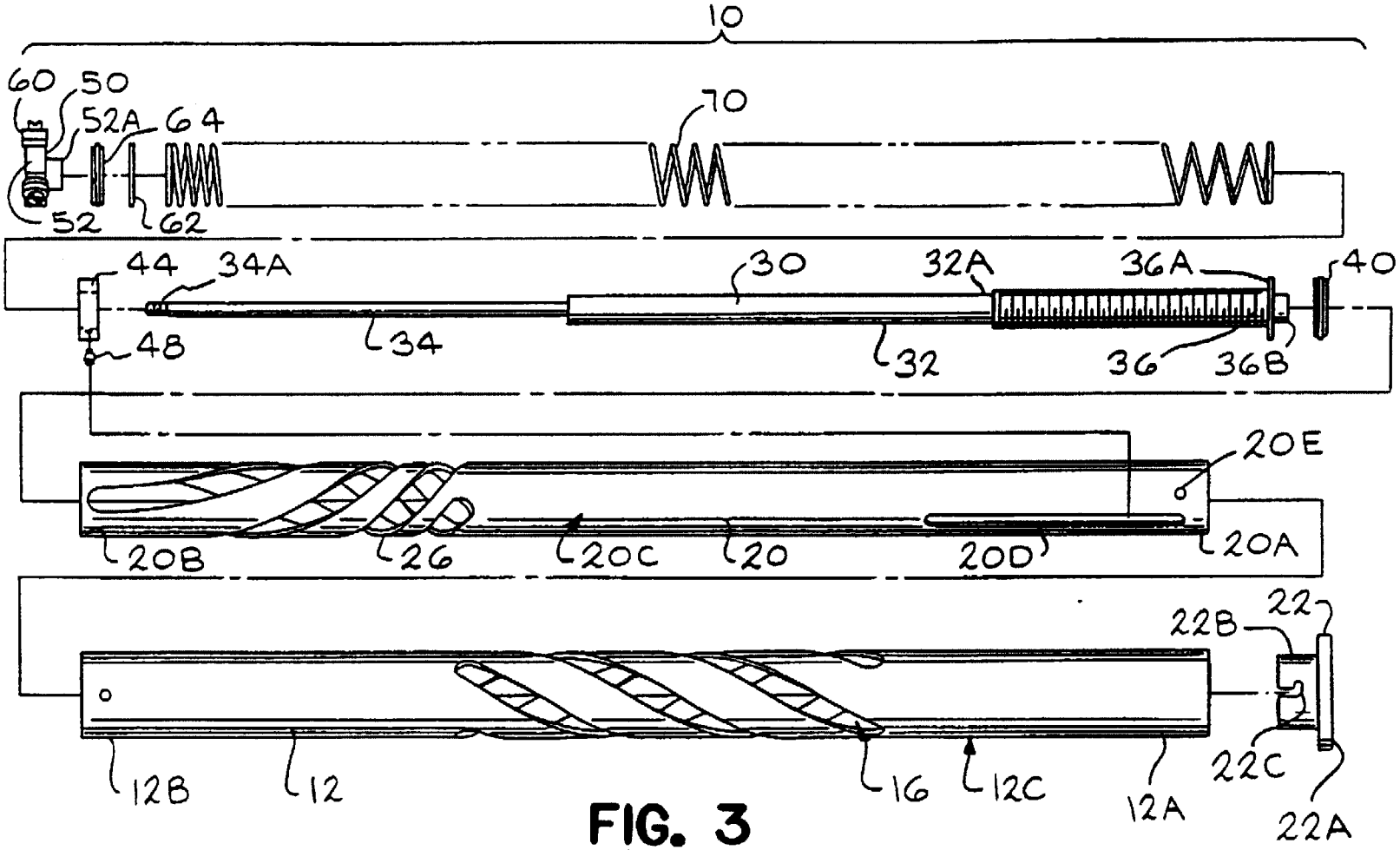
FIG. 3 is an exploded view of the counterbalance apparatus 10 showing the outer tubular member 12, the inner tubular member 20, the dampener 30, the spring 70 and the cam follower 50.

A dampener 30 preferably mounted within the inner tubular member 20 and includes a tubular body 32 and a piston rod 34 and has a piston cylinder design (FIGS. 3 and 4). A threaded rod 36 is mounted on the top end 32A of the body 32. The end of the threaded rod 36 opposite the dampener 30 has top ring 36A with an adjustment head 36B for setting the adjusted preload force on the spring 70. The dampener 30 is mounted in the inner tubular member 20 such that the threaded rod 36 on the top end 32A of the body 32, opposite the piston rod 34, is adjacent the top end 20A of the inner tubular member 20. The dampener 30 is preferably mounted in the inner tubular member 20 such that the adjustment head 36B of the threaded rod 36 extends through an opening in the end 20A of the inner tubular member 20 and through the end cap 22 and through an opening in the work surface 100B. Preferably, when the dampener 30 and threaded rod 36 are correctly positioned in the tubular member 20 and the apparatus 10 is correctly mounted on the work station 100, the adjustment head 36B is slightly below the top surface 100C of the work surface 100B. Preferably, the opening in the work surface 100B is slightly larger than the adjustment head 36B such as to allow a handle 38 to be mounted over the adjustment head 36B to allow rotation of the adjustment head 36B and thus, rotation of the dampener 30 (FIG. 1). A spacer 40 is preferably provided around the adjustment head 36B between the top ring 36A and the end cap 22. The spacer 40 is preferably provided with rollers 42 which extend between the cap 22 and the top ring 36A of the adjustment head 36B and which allow for easier rotation of the dampener 30. In an alternate embodiment (not shown), air trapped between the inner and outer members 12 or 20 acts as a dampener to prevent excessive speed of movement of the work surface 100B.

Figure 6:
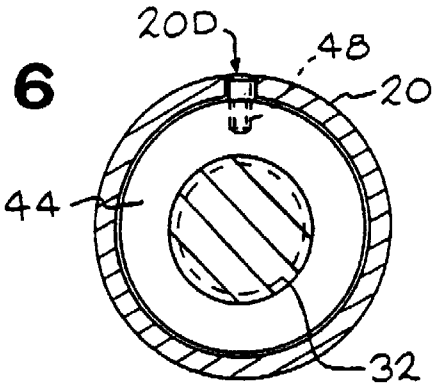
FIG. 6 is a cross-sectional view of FIG. 4 along the line 6—6 showing the locating pin 48 mounted in the adjustment nut 44.

An adjustment nut 44 is threadably mated on the threaded, outer surface of the threaded rod 36 and is able to move, through rotation, along the longitudinal axis A—A of the apparatus 10 (FIG. 4). A locking pin 48 is threadably mated into an opening in the perimeter of the adjustment nut 44. The pin 48 extends outward through the locking slot 20D in the sidewall 20C of the inner tubular member 20. The pin 48 is preferably of a size such as to easily move up and down the slot 20D while preventing the adjustment nut 44 from rotating as the dampener 30 and threaded rod 36 are rotated by the adjustment head 36B. The adjustment head 36B allows the distance between the adjustment nut 44 and the stopper 62 which is adjacent the bottom end 34A of the piston rod 34 having the cam follower 50 to be varied in order to vary the adjusted preload force on the spring 70 (to be described in detail hereinafter) (FIG. 6). The greater the load on the work surface 100B, the greater the compression of the spring 70. As the threaded rod 36 is rotated, the adjustment nut 44 moves up or down the threaded rod 36 along the longitudinal axis A—A of the apparatus 10 depending upon the direction of rotation of the threaded rod 36. In an alternate embodiment (not shown), there are two apparatuses operating on the work surface and the adjustment nuts are connected together so that the adjusted preload force on each of the apparatuses will be the same.

Figure 5:
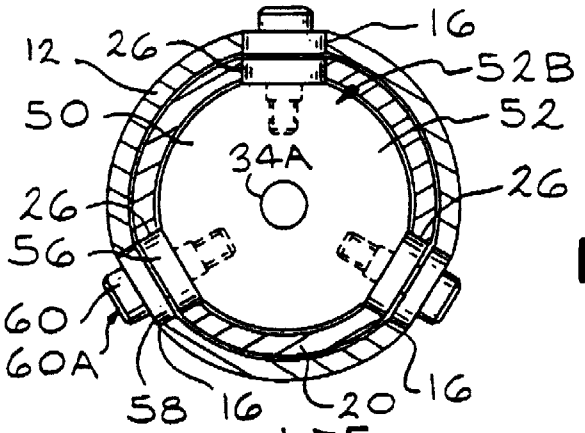
FIG. 5 is a cross-sectional view of FIG. 4 along the line 5—5 showing the cam follower 50 and the inner and outer cam rollers 56 and 58 in the inner and outer cam grooves 26 and 16, respectively of the tubular members 20 and 12.

The cam follower 50 is preferably threadably mated onto the bottom end 34A of the piston rod 34 opposite the body 32 of the dampener 30 (FIG. 4). The cam follower 50 includes a base 52 having a center portion 52A and inner and outer cam rollers 56 and 58. The piston rod 34 is preferably mounted through the center portion 52A of the cam follower 50 such that the cam follower 50 is unable to rotate around the piston rod 34 and the rollers 56 and 58 are equally spaced from the piston rods 34. The piston rod 34 is preferably able to rotate in the body 32 of the dampener 30 such that the cam follower 50 is able to rotate as it moves along the longitudinal axis A—A of the apparatus 10. Alternatively, the piston rod 34 is fixed and unable to rotate and the cam follower 50 is rotatably mounted onto the bottom end 34A of the piston rod 34. As shown in FIG. 5, the base 52 of the cam follower 50 has an essentially circular perimeter with flat portions 52B within which are mounted the cam rollers 56 and 58. Preferably, the diameter of the base 52 of the cam follower 50 is slightly smaller than the inner diameter of the inner tubular member 20 such that the cam follower 50 is able to freely rotate within the inner tubular member 20. In the first embodiment, there are three (3) pairs of inner and outer cam rollers 56 and 58. Each pair of cam rollers 56 and 58 is preferably identical and therefore only one pair will be described in detail. The rollers 56 and 58 are preferably roller bearings having the shape of wheels. The rollers 56 and 58 have an inner and outer portion 56A, 58A and 56B and 58B with ball bearings therebetween. The rollers 56 and 58 are mounted such that the axis of the wheel is perpendicular to the longitudinal axis A—A of the apparatus 10. The cam rollers 56 and 58 have holes (not shown) in the center through which is mounted a mounting pin 60 providing the axis of rotation. The mounting pin 60 preferably has a head 60A at one end and a threaded outer surface at the other end with a smooth cylindrical center portion. The center portion of the rollers 56 and 58 are mounted on the center portion of the mounting pin 60 so that the inner portion 56A and 58A remains stationary while the outer portion 56B and 58B rolls within the cam grooves 16 and 26. The cam rollers 56 and 58 could also be bronze bushings or plastic bushings. The cam rollers 56 and 58 are mounted on the perimeter of the base 52 of the cam follower 50 such that the head 60A of the pin 60 is adjacent the side of the outer cam roller 58 opposite the inner cam roller 56 and the threaded end extends into a threaded aperture (not shown) in the base 52 of the cam follower 50. The rollers 56 and 58 are removably mounted so as to allow the cam rollers 56 and 58 to be mounted on the base 52 of the cam follower 50 and so that each pair of cam rollers 56 and 58 is adjacent each of the inner and outer cam grooves 26 and 16. Preferably, the thickness of the rollers 56 and 58 is the same as the thickness of the tubular members 12 and 20 such that the cam rollers 56 and 58 ride along the grooves 16 and 26 and do not extend beyond sidewalls 12C and 20C of the members 12 and 20. The diameter of the cam rollers 56 and 58 is preferably the same as the width of the cam grooves 16 and 26 such that there is no extraneous movement of the cam rollers 56 and 58 in the cam grooves 16 and 26. The cam rollers 56 and 58 preferably have a diameter of 0.50 inches (1.3 cm) and a thickness of 0.19 inches (0.48 cm). In the first embodiment, the rollers 56 and 58 are spaced slightly apart such as to prevent friction between the cam rollers 56 and 58 during rotation (FIG. 5) and to accommodate the spacing between the members 12 and 20.

A stopper 62 is preferably mounted around the center portion 52A of the base 52 of the cam follower 50 on the side adjacent the body 32 of the dampener 30 (FIG. 4). The stopper 62 prevents the end of the spring 70 from making contact with the cam follower 50. A spacer 64 is preferably provided around the center portion 52A of the base 52 of the cam follower 50 between the stopper 62 and the base 52 of the cam follower 50. The spacer 64 has rollers 68 which contact the stopper 62 and the cam follower 50 and allow the cam follower 50 to freely rotate without interfering with the spring 70.

The spring 70 is preferably mounted around the outside of the dampener 30 and the threaded rod 36 between the stopper 62 and the adjustment nut 44 (FIG. 4). The spring 70 is preferably non-linear such that the spring 70 does not compress evenly along its length and the force of the spring 70 is not linear. The spring 70 is preferably a coil spring 70 having unevenly spaced coils which account for the non-linear compression of the spring 70. The spring 70 is mounted around the dampener 30 such that the coils of the spring 70 are spaced farther and farther apart as the spring 70 extends toward the adjustment nut 44. Alternatively, the spring 70 could have an hourglass shape such that the diameter of the coils adjacent the center of the spring 70 is smaller. The hourglass shape also allows for non-linear compression of the spring 70. The spring 70 could be any type and any form of force storage mechanism could be used instead of a coil spring such as for instance, a pneumatic spring. In addition, the spring 70 could be a torsional spring (not shown) having a resilient center portion fixably mounted in an outer shell which non-linearly varies the torque acting on the work surface 100B as a result of rotation of a shaft fixably mounted in the center portion which causes the inside of the center portion to exert a torque on the shaft.

A brake 72 is preferably located on the outer tubular member 12 of the apparatus 10 to lock the apparatus 10 at a certain vertical position (FIGS. 1 and 2). The brake 72 preferably includes a pin 74 having a handle 76 at one end. The pin 74 is extended through the outer tubular member 12 and into holes (not shown) in the inner tubular member 20. The exact vertical position of the work surface 100B is determined by the position of the holes in the inner tubular member 20. Alternatively, the brake 72 operates by friction and the pin 74 is threaded through the outer tubular member 12 and into contact with the inner tubular member 20 thus preventing the outer tubular member 12 and inner tubular member 20 from moving with respect to each other. In an alternate embodiment where the apparatus 10 is mounted between the legs, the legs are preferably provided with a brake (not shown).

Figures 7, 8:
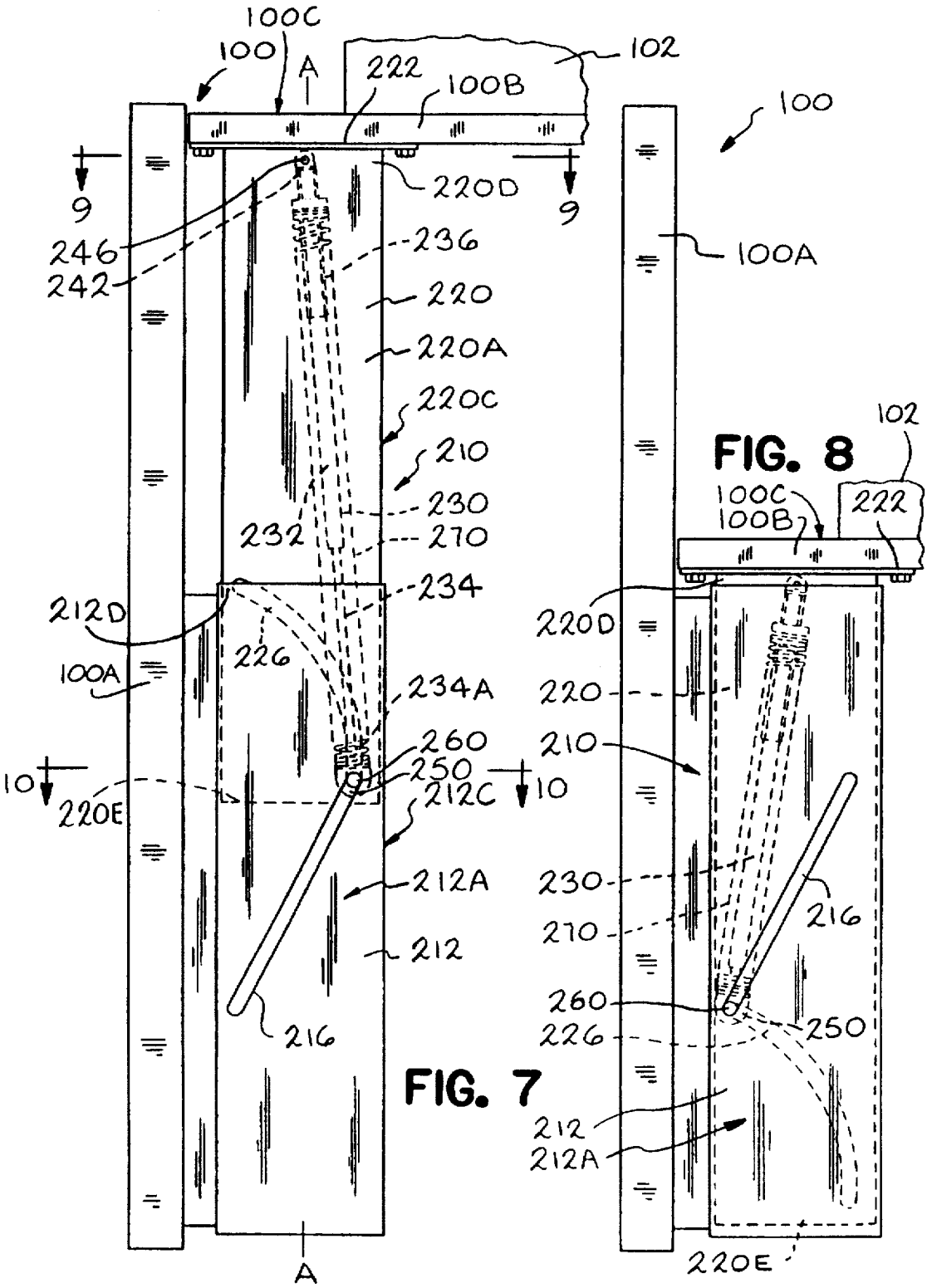
FIG. 7 is a side view of the counterbalance apparatus 210 of the second embodiment mounted on a work station 100 with the work surface 100B in the fully raised position.
FIG. 8 is a side view of the counterbalance apparatus 210 of the second embodiment mounted on a work station 100 with the work surface 100B in the fully lowered position.

FIGS. 7 to 10 show the second embodiment of the apparatus 210 of the present invention. The second embodiment of the apparatus 210 includes an outer rectangular member 212, an inner rectangular member 220, a dampener 230, a spring 270 and cam follower 250. The outer rectangular member 212 preferably is mounted to the panel 100A of the work station 100 (FIGS. 7 and 8) similarly to the outer tubular member 12 of the first embodiment (FIGS. 1 and 2). The outer rectangular member 212 has a rectangular cross-section with a front wall 212A, a back wall 212B and two sidewalls 212C. The outer rectangular member 212 is mounted such that one of the sidewalls 212C is mounted to the panel 100A of the work station 100 (FIG. 7). The front and back walls 212A and 212B of the outer rectangular member 212 each have diagonally oriented outer cam grooves 216. The outer cam grooves 216 are preferably identical and are evenly spaced between the ends of the member 212. Preferably, the slope of the line of the outer cam grooves 216 is linear and is similar to the slope of the curve of the outer cam grooves 16 of the first embodiment. The outer cam grooves 216 are preferably mirror images of each other such that as the cam follower 250 moves vertically, along the members 212 and 220 parallel to the axis A—A of the apparatus 210, as the pairs of cam rollers 256 and 258 follow both grooves 216 and 226 simultaneously.

The inner rectangular member 220 has a rectangular cross-section with a front wall 220A, a back wall 220B and two sidewalls 220C with a top and bottom end 220D and 220E. The bottom end 220E of the inner rectangular member 220 is telescopically mounted into the top end 212D of the outer rectangular member 212 such that the front wall 220A of the inner rectangular member 220 is adjacent the front wall 212A of the outer rectangular member 212. The top end 220D of the inner rectangular member 220 is preferably mounted on an end cap 222 to the underside of a work surface 100B. The end cap 222 of the second embodiment is preferably a flat plate which extends outward beyond the walls 220A, 220B and 220C of the inner rectangular member 220. The end cap 222 may be permanently or removably mounted on the top end 220D of the inner rectangular member 220 by any well known means. The front and back walls 220A and 220B of the inner rectangular member 220 are provided with curved cam grooves 226. Preferably, the cam grooves 226 on the front and back walls 220A and 220B of the inner rectangular member 220 are mirror images of each other so that the pairs of rollers 256 and 258 of the cam follower 250 run along both grooves 226 simultaneously.

Figure 9:
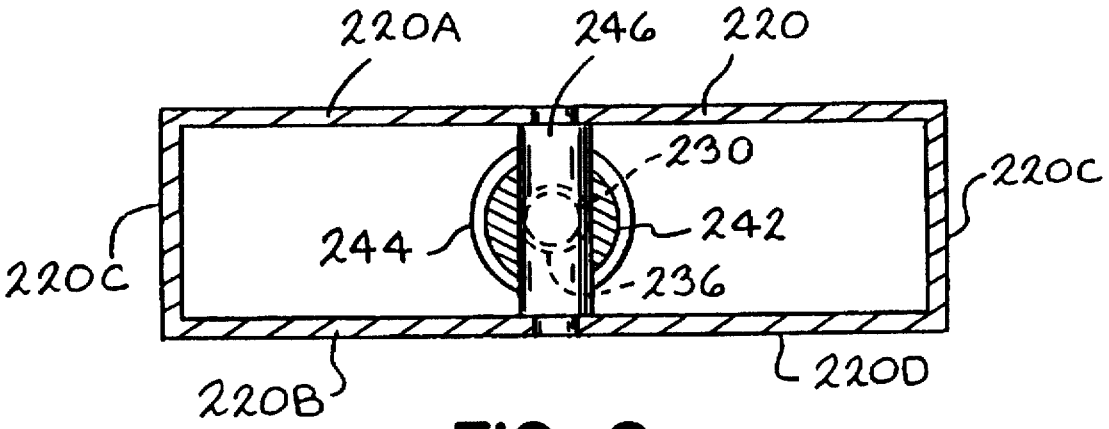
FIG. 9 is a cross-sectional view of the counterbalance apparatus 210 of FIG. 7 along the line 9—9 with the rod 246 in elevation showing the dampener 230 pivotably mounted on the inner, rectangular member 220.

The dampener 230 is preferably mounted within the inner rectangular member 220. The dampener 230 is preferably similar to the dampener 30 of the first embodiment and has a threaded rod 236. The top end of the threaded rod 236 is provided with a loop 242 which is pivotably mounted at the top end 220D of the inner rectangular member 220 by a rod 246 which extends from the front wall 220A through the loop 242 at the top end of the threaded rod 236 and into the back wall 220 of the inner rectangular member 220 (FIG. 9). The dampener 230 is able to pivot such that the bottom end 234A of the piston rod 234 of the dampener 230 having the cam follower 250 is able to move from adjacent one sidewall 220C of the inner rectangular member 220 to adjacent the other sidewall 220C. The movement of the bottom end 234A of the piston rod 234 allows the cam rollers 256 and 258 of the cam follower 250 to move along the cam grooves 216 and 226. A adjustment nut 244 is mounted on the threaded rod 236 adjacent the work surface 100B. Preferably, the position of the adjustment nut 244 along the body 232 of the dampener 230 is able to be adjusted similar to the adjustment nut 44 of the first embodiment to change the adjustable preload force on the spring 270 (FIGS. 7 and 8).

Figure 10:
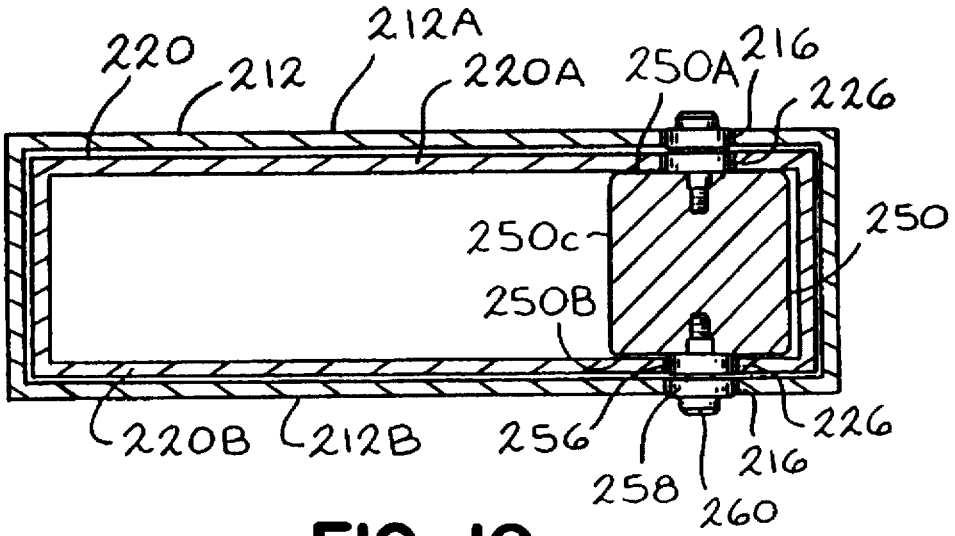
FIG. 10 is a cross-sectional view of the counterbalance apparatus 210 of FIG. 7 along the line 10—10 showing the inner and outer cam rollers 256 and 258 of the cam follower 250 in the inner and outer cam grooves 216 and 226 respectively, of the inner and outer rectangular members 212 and 220.
Figure 11:
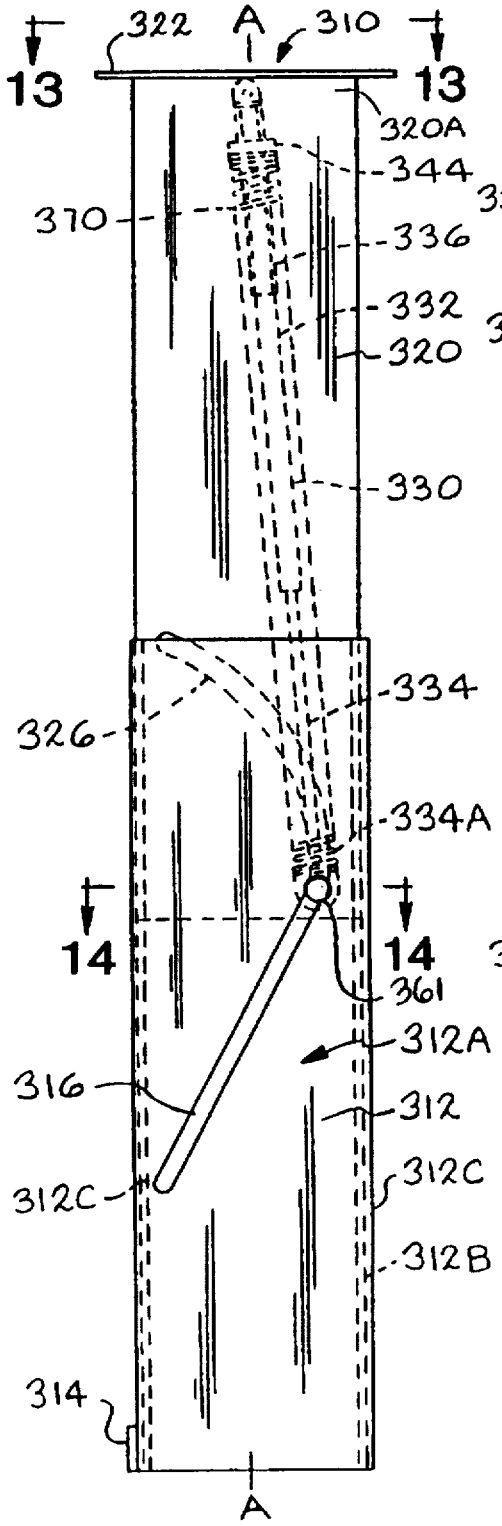
FIG. 11 is a front view of the counterbalance apparatus 310 of the third embodiment showing the outer and inner plate members 312 and 320.

The cam follower 250 is preferably mounted on the bottom end 234A of the piston rod 234 and is preferably square in shape with a front wall 250A, a back wall 250B and two sidewalls 250C (FIG. 10). A pair of cam rollers 256 and 258 is mounted on each of the front wall 250A and the back wall 250B adjacent the front and back walls 212A and 220A and 212B and 220B, respectively, of the outer and inner rectangular members 212 and 220. The cam rollers 256 and 258 of the cam follower 250 are preferably similar to the cam rollers 56 and 58 of the first embodiment. The cam rollers 256 and 258 are preferably mounted in the center of the front and back walls 250A and 250B of the cam follower 250 by mounting pins 260. The cam follower 250 moves along the cam grooves 216 and 226 of the outer and inner tubular member 212 and 220 simultaneously as the members 212 and 220 are moved together and apart. The cam follower 250 of the second embodiment does not need to rotate due to the rectangular shape of the members 212 and 220. The shape of the cam follower 250 and the fact that the cam follower 250 does not rotate allows the end of the spring 270 adjacent the cam follower 250 to be positioned directly on the cam follower 250.

Figure 12:
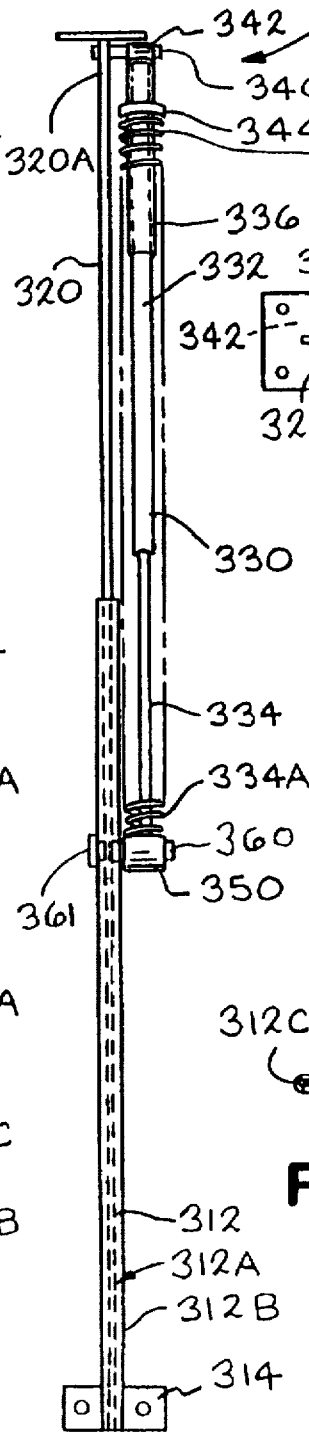
FIG. 12 is a side view of the counterbalance apparatus 310 of FIG. 11.
Figure 13:
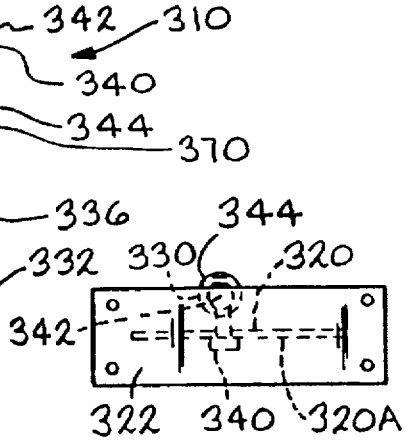
FIG. 13 is a top view of the counterbalance apparatus 310 of FIG. 11 showing the dampener 330 mounted at the top end 320A of the inner plate member 320.
Figure 14:
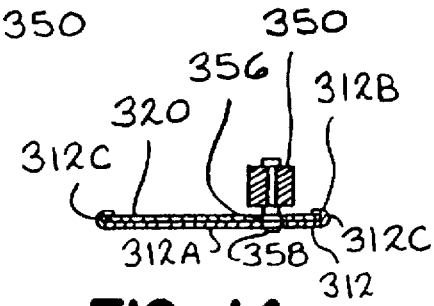
FIG. 14 is a cross-sectional view of the counterbalance apparatus 310 of FIG. 11 showing the inner plate member 320 telescoped in the outer plate member 312 and the cam follower 350 with the rollers 356 and 358.

FIGS. 11 to 14 show the counterbalance apparatus 310 of the third embodiment. The outer and inner plate members 312 and 320 of the third embodiment are flat plates and are similar to the members 212 and 220 of the second embodiment. The outer plate member 312 has a wall 312A similar to the front wall 212A of the outer rectangular member 212 of the second embodiment. The outer plate member 312 is preferably mounted to the panel of the work station (not shown) or the base of the table (not shown) by a bracket 314 which is integrally formed as part of the side 312C of the wall 312A of the outer plate member 312. However, it is understood that any type of bracket may be used and the bracket may be separate from the apparatus 310. Similar to the second embodiment, the inner plate member 320 is preferably provided with a cap 322 which allows for the mounting of the inner plate member 320 to the work surface (not shown). Both sides 312C of the wall 312A have the U-shaped flange 312B which provide a channel along the back side of the wall 312A between which the inner plate member 320 is mounted (FIG. 14). The dampener 330, adjustment nut 344 and spring 370 of the third embodiment are similar to those of the second embodiment. As in the second embodiment, the end of the threaded rod 336 opposite the body 332 of the dampener 330 adjacent the top end 320A of the inner plate member 320 is preferably provided with a loop 342 through which is mounted one end of a pin 340 (FIG. 13). The other end of the pin 340 is securely mounted on the top end 320A of the inner plate member 320. The dampener 330 and threaded rod 336 is mounted on the side of the inner plate member 320 opposite the outer plate member 312 (FIG. 12). The pin 340 and loop 342 allow for movement of the bottom end 334A of the piston rod 334 of the dampener 330 having the cam follower 350 across the width of the inner and outer plate members 312 and 320. The cam follower 350 is preferably mounted on the bottom end 334A of the piston rod 334 opposite the body 332 similarly to the mounting of the cam follower 250 of the second embodiment. The cam follower 350 is preferably a square block with one pair of rollers 356 and 358 mounted on the side of the cam follower 350 adjacent the inner plate member 320 (FIG. 14). A guide 361 is preferably mounted on each of the guide pins 360 adjacent the outer rollers 358 after the rollers 358 and 356 are mounted in the cam grooves 316 and 326, respectively (FIG. 12). The guide 361 is preferably larger in size than the width of the outer cam groove 316 and is mounted on the pin 360 such that the guide 361 is adjacent the side of the outer plate member 312 opposite the inner plate member 320. Preferably, the guide 361 prevents the rollers 356 and 358 from slipping out of the cam grooves 326 and 316, respectively, due to extraneously movement of the dampener 332 and the cam follower 350 toward and away from the plate members 312 and 320.

Figures 15, 17, 18:
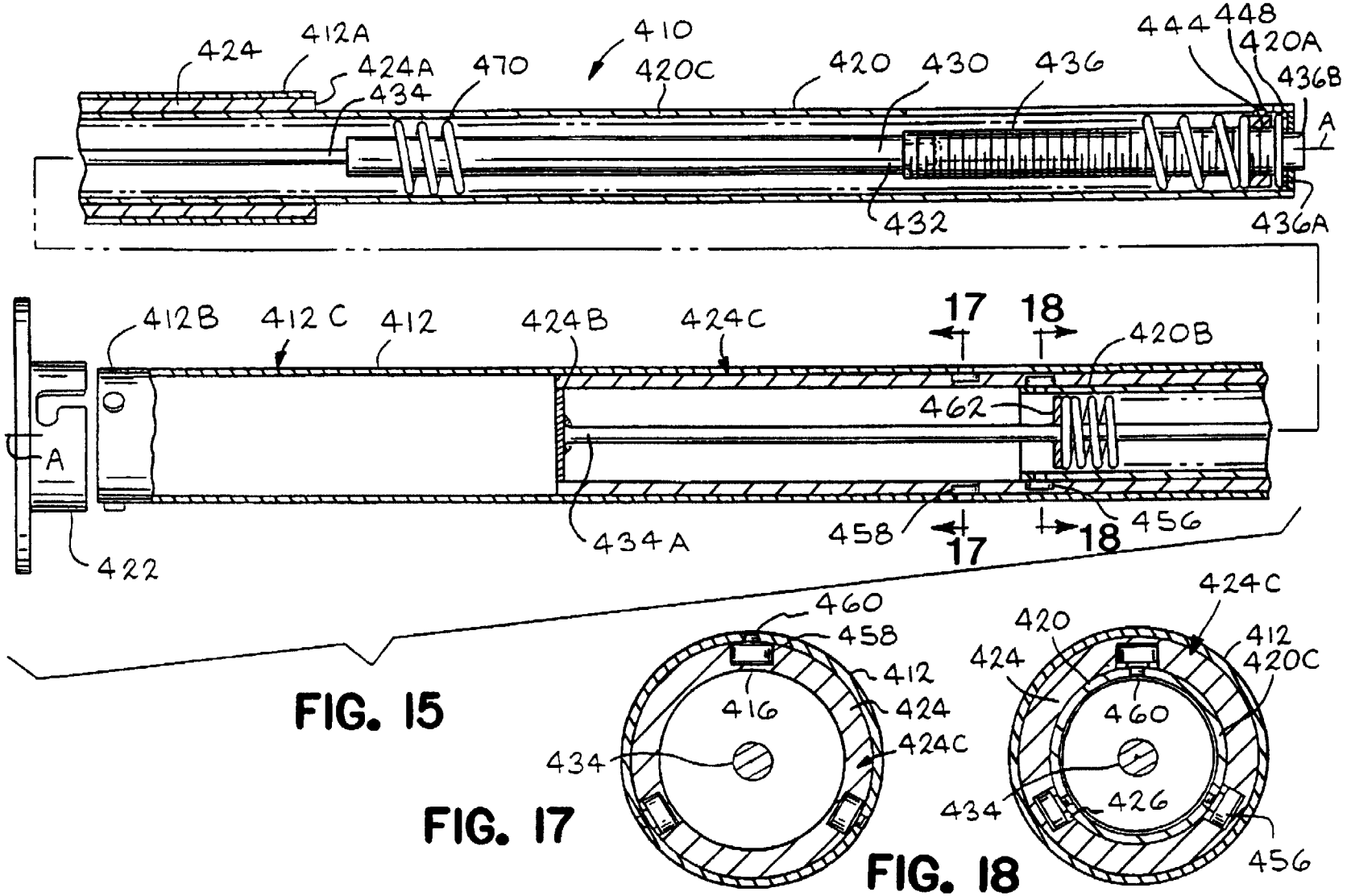
FIG. 15 is a cross-sectional view of the counterbalance apparatus 410 of the fourth embodiment in the extended position with the cam rollers 456 and 458 out of position showing the inner tubular member 420, the outer tubular member 412 and the middle tubular member 424.
FIG. 17 is a cross-sectional view of FIG. 15 along the line 17—17 showing the outer cam rollers 458 in the outer cam grooves 416 in the middle tubular member 424.
FIG. 18 is a cross-sectional view of FIG. 15 along the line 18—18 showing the inner cam rollers 456 in the inner cam grooves 426 in the middle tubular member 424.
Figure 16:
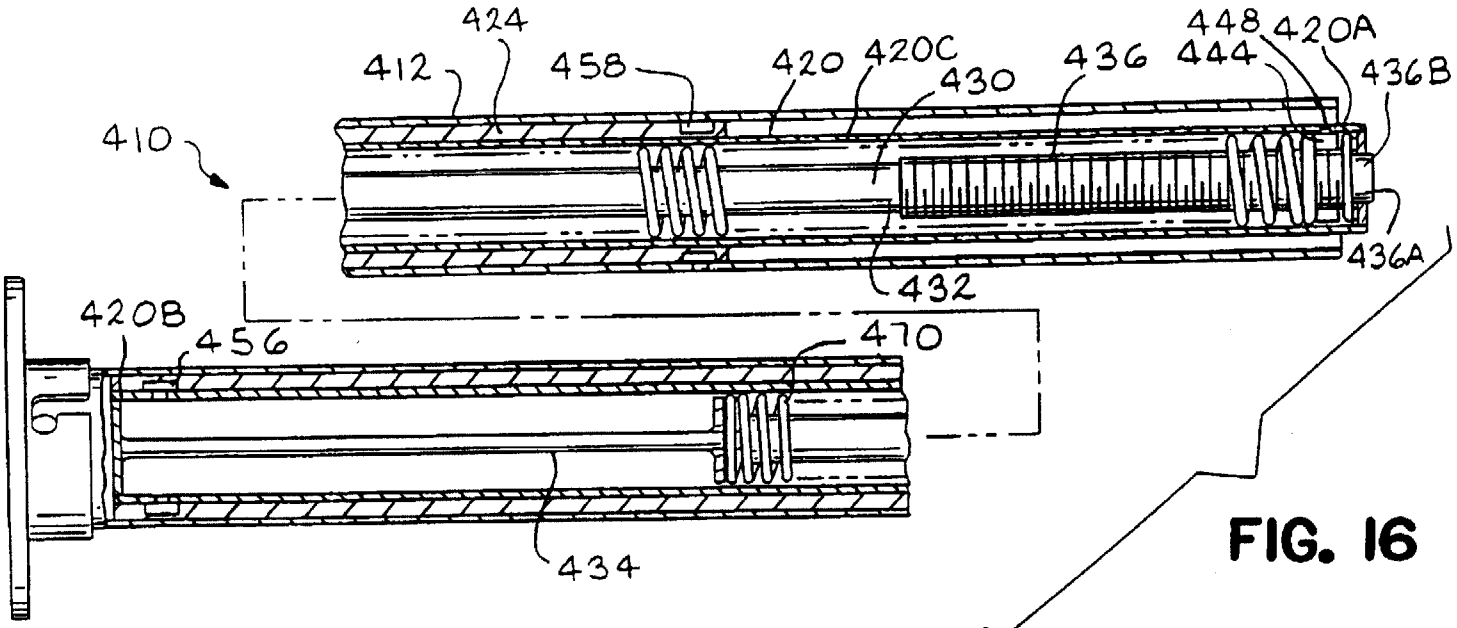
FIG. 16 is a cross-sectional view of the counterbalance apparatus 410 of the fourth embodiment in the compressed position with the cam rollers 456 and 458 out of position showing the outer cam rollers 458 mounted between the outer tubular member 412 and the middle tubular member 424 and the inner cam rollers 456 mounted between the inner tubular member 420 and the middle tubular member 424.

FIGS. 15 to 21 show the counterbalance apparatus 410 of the fourth embodiment of the invention. The apparatus 410 includes an outer tubular member 412, an inner tubular member 420, a middle tubular member 424, a dampener 430 and a spring 470. The outer, middle and inner tubular members 412, 424 and 420 preferably all have a similar hollow, cylindrical shape. The outer and inner tubular members 412 and 420 preferably have a length of 23.0 inches (58.4 cm) and the middle tubular member 424 preferably has a length of 15.0 inches (38.1 cm). The outer tubular member 412 has an open top end 412A and an open bottom end 412B with a sidewall 412C therebetween. The bottom end 412B is provided with an end cap 422 similar to the end cap 22 of the first embodiment. Outer cam rollers 458 are mounted on the inside surface of the sidewall 412C of the outer tubular member 412 around the inner circumference of the outer tubular member 412 (FIG. 17). Preferably, there are three (3) outer cam rollers 458 evenly spaced 120° apart around the circumference of the outer tubular member 412 in the same horizontal plane. The cam rollers 458 are preferably positioned such that when the inner tubular member 420 is fully extended upwards, the bottom end 420B of the inner tubular member 420 is spaced slightly above the outer cam rollers 458. However, the exact placement of the rollers 456 and 458 will depend upon the length of the cam grooves 426 and 416, respectively. The inner tubular member 420 has a top 420A and a bottom 420B with a sidewall 420C, therebetween. The outside surface of the sidewall 420 is provided with inner cam rollers 456 (FIG. 18). There are preferably three (3) inner cam rollers 456 evenly spaced 120° apart around the outer circumference of the inner tubular member 420 in the same horizontal plane. The inner cam rollers 456 are preferably mounted adjacent the bottom end 420B of the inner tubular member 420 (FIG. 16). The inner and outer cam rollers 456 and 458 are preferably similar in size and shape to the rollers 56 and 58 of the first embodiment. The cam rollers 456 and 458 are preferably mounted such that the axis of the rollers 456 and 458 are perpendicular to the longitudinal axis A—A of the apparatus 410. The cam rollers 456 and 458 are preferably mounted on pins 460 which are mounted through the inner or outer tubular members 412 or 420, respectively. Preferably, the pins 460 do not extend beyond the rollers 456 or 458 such as to interfere with rotation of the rollers 456 or 458 in the inner or outer cam grooves 416 and 426. The cam rollers 456 and 458 may be mounted to the sidewalls 412C and 420C of the members 412 and 420 by any well known method.

Figure 19:
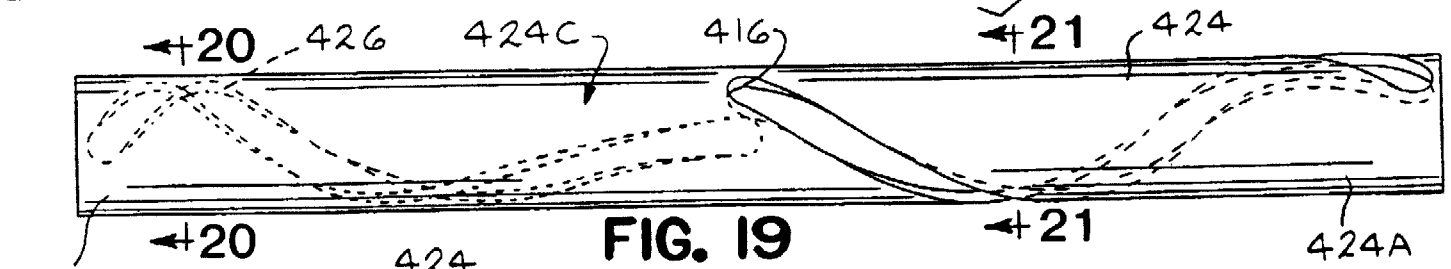
FIG. 19 is a side view of the middle tubular member 424 showing the inner and outer cam grooves 426 and 416.
Figure 20:
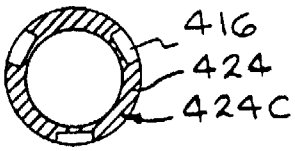
FIG. 20 is a cross-sectional view of FIG. 19 along the line 20—20 showing the inner cam grooves 426 in the middle tubular member 424.
Figure 21:
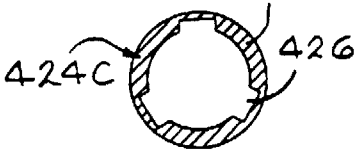
FIG. 21 is a cross-sectional view of FIG. 19 along the line 21—21 showing the outer cam grooves 416 in the middle tubular member 424.

The middle tubular member 424 has an open top end 424A, a closed bottom end 424B and a sidewall 424C therebetween. The outer diameter of the middle tubular member 424 is preferably slightly smaller than the inner diameter of the outer tubular member 412 and the inner diameter of the middle tubular member 424 is preferably slightly larger than the outer diameter of the inner tubular member 420. The middle tubular member 424 is positioned between the outer and inner tubular members 412 and 420 when the bottom end 420B of the inner tubular member 420 is telescopically inserted into the top end 412A of the outer tubular member 412. The outside surface and the inside surface of the sidewall 424C of the middle tubular member 424 have outer and inner cam grooves 416 and 426, respectively (FIGS. 19 to 21). The outer cam grooves 416 are preferably located at the top end 424A of the middle tubular member 424 and the inner cam grooves 426 are preferably located at the bottom end 424B of the middle tubular member 424. Preferably, the inner and outer cam grooves 426 and 416 of the middle tubular member 424 are positioned such that the grooves 416 and 426 do not cross or intersect and only overlap in the very center of the middle tubular member 424 in about a 1.25 inch (3.18 cm) area (FIG. 19). The outer cam grooves 416 are preferably similar in size, shape and angle to the outer cam grooves 16 of the outer tubular member 12 of the first embodiment. The inner cam grooves 426 are preferably similar in size, shape and curve to the inner cam grooves 26 of the inner tubular member 20 of the first embodiment. The depth of the inner or outer cam grooves 426 or 416 is preferably at least equal to the thickness of the inner or outer cam rollers 456 and 458 (FIGS. 20 and 21). The thickness of the sidewall 424C of the middle tubular member 424 is at least slightly greater than the depth of the grooves 416 or 426.

The dampener 430 is preferably mounted within the inner tubular member 420 similar to the mounting of the dampener 70 in the inner tubular member 20 of the first embodiment (FIGS. 15 and 16). The bottom end 434A of the piston rod 434 opposite the body 432 of the dampener 430 is permanently mounted on the closed bottom end 424B of the middle tubular member 424. As in the first embodiment, the piston rod 434 of the dampener 430 is preferably able to rotate in the body 432 of the dampener 430. Alternately, the piston rod 434 is rotatably mounted in the closed bottom end 424 of the middle tubular member 424. A stopper 462 is mounted on the piston rod 434 between the bottom end 424B and the body 432 of the dampener 430 (FIG. 15). The exact position of the stopper 462 is dependent upon the length of the spring 470. Similar to the first embodiment, a threaded rod 436 is mounted on the end of the body 432 of the dampener 430. The threaded rod 436 has a top ring 436A and an adjustment head 436B. The adjustment head 436B extends through an opening in the work surface of the work station (not shown). An adjustment nut 444 with a locating pin 448, similar to that of the first embodiment is threadably mounted around the threaded rod 436. The spring 470 is mounted between the adjustment nut 444 and the stopper 462 around the dampener 430. The mounting of the piston rod 434 on the end 424B of the middle tubular member 424, transfers the force of the spring 470 from the stopper 462 to the bottom end 424B of the middle tubular member 424. The adjustment head 436B and the adjustment nut 444, as in the first embodiment, allow the adjusted preload force on the spring 470 to be set. The mounting of the piston rod 434 in the closed bottom end 424B of the member 424 and the rotation of the piston rod 434 allows the middle tubular member 424 to rotate and move as the inner and outer members 420 and 412 are moved together and apart such that the rollers 456 and 458 of the inner and outer tubular members 420 and 412 move along the inner and outer cam grooves 426 and 416 around sidewall 424C of the middle tubular member 424.

IN USE

The apparatuses 10, 210, 310 and 410 of all four (4) embodiments preferably operate similarly. To lower the work surface 100B, the user exerts a force downward on the work surface 100B which compresses the spring 70, 270, 370 or 470. As the spring compresses, the spring 70, 270, 370 or 470 exerts an upward force on the work surface 100B. In response to the upward force of the spring 70, 270, 370 or 470, the inner cam grooves 26, 226, 326 or 426 exert an upward force on the inner cam rollers 56, 256, 356 or 456 and the outer cam grooves 16, 216, 316 and 416 exert an upward force on the outer cam rollers 58, 258, 358 and 458. The inner and outer cam rollers 56, 256, 356 or 456 and 58, 258, 358 or 458 travel on the underneath side of the inner or outer cam grooves 26, 226, 326 or 426 and 16, 216, 316 or 416 such that the cam grooves 26, 226, 326 or 426 and 16, 216, 316 or 416 are carrying the force of the spring 70, 270, 370 or 470. The curve of the inner cam grooves 26, 226, 326 or 426 is preferably non-linear and the spring 70, 270, 370 or 470 is preferably non-constant. As the spring 70, 270, 370 or 470 is compressed and the inner cam roller 56, 256, 356 or 456 moves along the inner cam grooves 26, 226, 326 or 426 the normal force exerted on the inner cam roller 56, 256, 356 or 456 changes direction in order to compensate for the change in force exerted by the spring 70, 270, 370 or 470. The inner cam grooves 26, 226, 326 or 426 preferably carry the force of the spring 70, 270, 370 or 470 beyond the initial preload force ($F_o$). The slope of the curve of the inner cam grooves 26, 226, 326 or 426 is directly related to the slope of the curve of the non-constant spring 70, 270, 370 or 470. The interaction of the spring 70, 270, 370 or 470 and the inner cam roller 56, 256, 356 or 456 allows for a constant force acting on the work surface 100B along the entire length of movement of the work surface 100B. Preferably, this is true regardless of the weight of the load 102 on the work surface 100B. The interaction of the spring 70, 270, 370 or 470 and the cam rollers 56, 256, 356 or 456 or 58, 258, 358 or 458 in the cam grooves 26, 226, 326 or 426 or 16, 216, 316 or 416 also provide a constant torque throughout the entire movement of the work surface 100B. The relationship between the spring 70, 270, 370 or 470 and the inner cam grooves 26, 226, 326 or 426 allows the outer cam grooves 16, 216, 316 or 416 to have a linear slope. Preferably, as the spring 70, 270, 370 or 470 is compressed, the inner cam grooves 26, 226, 326 or 426 take an increasing share of the force of the spring 70, 270, 370 or 470 while the outer cam grooves 16, 216, 316 or 416 carry a constant share of the force.

The spring 70, 270, 370 or 470 is selected based upon the range of load 102 on the work station 100 which is used to determine the adjusted preload force applied to the apparatus 10, 210, 310 or 410. The adjusted preload force is the initial preload force ($F_o$) which is necessary to hold up the work surface 100B plus the force which is necessary to compensate for the load 102 on the work surface 100B. The spring 70, 270, 370 or 470 preferably is non-constant and changes its force output at a constant, compound rate. Changing the range of adjusted preload force could require changing the spring 70, 270, 370 or 470 and the curve of the inner cam grooves 26, 226, 326 or 426. The spring 70, 270, 370 or 470 is preferably defined by the equation:

$$F=F_0\times e^{-KY}$$

where F is the force exerted by the spring 70, 270, 370 and 470, $F_o$ is the initial preload force on the spring 70, 270, 370 or 470 which holds the work surface 100B up with no load 102 on the table. The initial preload force ($F_o$) is preferably equal to the amount of force pushing down on the apparatus 10, 210, 310 or 410 by the work surface 100B. Preferably, in the initial position with the apparatus 10, 210, 310 or 410 fully extended, the spring 70, 270, 370 or 470 is not fully extended. Preferably, the spring 70, 270, 370 or 470 is compressed to provide the initial preload force ($F_o$). K is the constant defining the compound rate of change of the spring rate and Y is the displacement or the compression distance of the spring 70, 270, 370 or 470 along the longitudinal axis A—A of the apparatus 10, 210, 310 or 410. The displacement of the spring 70, 270, 370 or 470 is preferably calculated from a starting point of zero (0) which represents the length of the spring 70, 270, 370 or 470 when the cam follower 50, 250, 350 or 450 is at the bottom of the inner cam grooves 26, 226, 326 or 426 and the apparatus 10, 210, 310 or 410 is in the fully extended position. Y is preferably always a negative number. Preferably, there is a constant relationship between the force exerted by the spring (F) and the instantaneous spring constant $\Delta F/\Delta Y$ such that $F/(\Delta F/\Delta Y)$ remains constant throughout the compression of the spring 70, 270, 370 or 470. In the alternate embodiment having a torsional spring, the inner cam grooves are selected to compensate for the non-constant torque of the spring so that the torque acting on the work surface 100B is constant throughout the travel of the work surface 100B. Once the spring 70, 270, 370 or 470 is selected, the slope of the inner cam grooves 26, 226, 326 or 426 is determined using the equation:

$$X=\frac{\left(Y-\frac{1}{K}\left[1-e^{-KY}\right]\right)}{M}$$

where X is the displacement of the inner cam roller 56, 256, 356 or 456 along the inner cam grooves 26, 226, 326 or 426, M is the slope of the line representative of the outer cam grooves 16, 216, 316 or 416. In addition, the inner cam grooves 26, 226, 326 or 426 can be adjusted to compensate for the addition of the friction force caused by the inner cam roller 56, 256, 356 or 456 moving along the inner cam grooves 26, 226, 326 or 426. The outer cam grooves 16, 216, 316 or 416 is linear and shares the force of the spring with the inner cam grooves 26, 226, 326 or 426 and compensates for the adjusted preload force or constant portion of the force applied to the apparatus 10, 210, 310 or 410. The outer cam grooves 16, 216, 316 or 416 also allows the work surface 100B to travel an additional distance beyond the distance resulting from compression of the spring 70, 270, 370 or 470. The angle of the inner cam grooves 26, 226, 326 or 426 varies to compensate for the change in spring rate of the spring 70, 270, 370 or 470. The axial length of the inner cam grooves 26, 226, 326 or 426 represent the total compression of the spring 70, 270, 370 or 470. The axial length of the inner cam grooves 26, 226, 326 or 426 and the axial length of the outer cam grooves 16, 216, 316 or 416 provide for the total amount of distance traveled by the work surface 100B.

The choice of spring 70, 270, 370 or 470 and inner and outer cam grooves 26, 226, 326 or 426 and 16, 216, 316 or 416 allows for a constant force and a small constant torque acting on the work surface 100B by the apparatus 10, 210, 310 or 410 throughout the entire movement of the work surface 100B regardless of the specific adjusted preload force chosen within the range. Once the spring 70, 270, 370 or 470 and inner and outer cam grooves 26, 226, 326 or 426 and 16, 216, 316 or 416 are selected, the apparatus 10, 210, 310 or 410 is assembled and mounted onto the panel 100A of the work station 100. In the first, second and fourth embodiments, the end caps 22, 222 and 422 on the outer and inner members 12,212,412 and 20, 220 and 420 allow the apparatuses 10, 210 and 410 to be easily mounted to the work station.

In the first embodiment as shown in FIGS. 1 and 2, the apparatus 10 is mounted to the panel 100B of the work station 100 so that the brackets 14 extend around the outer tubular member 12. The bottom end 12B of the outer tubular member 12 is mounted on the end cap 18 and the top end 20A of the inner tubular member 20 is mounted on the end cap 22 which is mounted to the underside of the work surface 100B such that the adjustment head 36B extends upward through the opening in the work surface 100B. The adjustment handle 38 is attached onto the adjustment head 36B and is rotated until the initial tension or adjusted preload force on the spring 70 is correct for the weight of the work surface 100B and any items on the work station 100. Once the apparatus 10 is properly installed and the adjusted preload force is correctly set, the forces exerted on the work surface 100B are in equilibrium which allows the work surface 100B to be easily moved up or down in a vertical direction.

To move the work surface 100B, the user exerts a small force on the work surface 100B in the direction the work surface 100B is to be moved. During vertical movement of the work surface 100B, the inner tubular member 20 telescopes in and out of the outer tubular member 12. The operation of the apparatus 10 is the same but opposite for lifting the work surface 100B as for lowering the work surface 100B. Therefore, only raising the work surface 100B will be described in detail. In the fully compressed position, with the work surface 100B in the lowermost position, the inner tubular member 20 is almost fully within the outer tubular member 12 and the spring 70 and dampener 30 are in the compressed position. As the work station 100 is moved vertically upward, the inner tubular member 20 is lifted upward, out of the outer tubular member 12. The force of the spring 70 pushing upward assists the lifting force of the user to allow the user to lift a work surface 100B having a greater weight by exerting a relatively small force. In addition, the downward force of the inner cam grooves 26 on the inner cam roller 56 works against the upward force of the spring 70 such that the force exerted on the work surface 100B remains constant throughout the complete movement of the work surface 100B. The force on the cam rollers 56 and consequently, the cam grooves 26 changes as the compression of the spring 70 is changed. The greater the compression of the spring 70, the greater the load on the cam grooves 26. The cam roller 56 travels along the underneath side of the cam grooves 26 which allows the cam grooves 26 to carry a greater part of the force of the spring 70. The force on the outer cam roller 58 and consequently, the outer cam grooves 16 remains constant throughout the entire movement of the work surface 100B and compensates for the adjusted preload force on the spring 70. As the work surface 100B moves upward and the spring 70 expands, the piston rod 34 of the dampener 30 is extended out of body 32 of the dampener 30. The dampener 30 preferably exerts no upward or downward force on the apparatus 10 or the work surface 100B when the apparatus 10 is not moving. Preferably, during normal operation of the apparatus 10, the dampener 30 exerts only a negligible force when the apparatus 10 is moving. However, as the speed of movement increases, the force exerted by the dampener 30 in the direction opposite of the movement increases. The dampener 30 is used to prevent the work surface 100B from raising or lowering suddenly, if a load 102 is added or removed from the work surface 100B such that the adjusted preload force setting of the apparatus 10 is incorrect. The dampener 30 reduces the rate of ascent and descent of the work surface 100B, if the rate exceeds a preset limit. As the inner tubular member 20 is moved upward, the pairs of cam rollers 56 and 58 on the cam follower 50 rotate within and follow along the cam grooves 16 and 26. In the initial compressed position, the cam follower 50 is located at the bottom most point of the outer cam grooves 16 and at the top most point of the inner cam grooves 26. As the inner tubular member 20 is lifted upward, the inner cam grooves 26 begins to overlap the outer cam grooves 16. The outer cam rollers 58 follow the outer cam grooves 16 upward toward the top of the outer cam grooves 16 at the same time as the inner cam rollers 56 follow the inner cam grooves 26 downward toward the bottom of the inner cam grooves 26. As the cam rollers 56 and 58 move along the grooves 16 and 26, the cam rollers 56 and 58 rotate about their axises perpendicular to the axis A—A of the apparatus 10 to allow for easier travel of the cam follower 50 in the grooves 16 and 26. In addition, the cam follower 50 rotates around the longitudinal axis A—A of the apparatus 10 as the inner and outer tubular members 20 and 12 are moved together and apart. Rotation of the cam follower 50 is essential to allow the cam rollers 56 and 58 to follow the spiral cam grooves 16 and 26 around the circumference of the tubular members 12 and 20. The angle of the curve of the outer cam grooves 16 allows the work station 100 to move with a constant force. The angle of the curve of the inner cam grooves 26 allows the force needed to move the work surface 100B up and down to remain constant regardless of the adjusted preload force on the apparatus 10. The inner cam rollers 56 move along the inner cam grooves 26 to counteract the changing force of the spring 70, so as to allow the work surface 100B to be raised and lowered using a constant force. The outer cam rollers 58 of the cam follower 50 move along the outer cam grooves 16 in the outer tubular member 12 to counteract the constant adjusted preload force. In addition, the outer cam grooves 16 provide the additional distance of movement of the work surface 100B not provided by the spring 70. The inner cam grooves 26 allow the force exerted on the work surface 100B to remain constant by varying the force normal to the inner cam rollers 56 to compensate for the varying force exerted by the spring 70 resulting from the compression of the spring 70. The inner cam rollers 56 of the cam follower 50 move along the cam grooves 26 in the inner tubular member 20 to compensate for the changing force of the spring 70 to provide a constant force output. The non-linear curve of the inner cam grooves 26 creates a camming action between the inner cam rollers 56 and the inner cam grooves 26 which varies the normal force exerted on the cam rollers 56 by the cam grooves 26. As the rollers 56 and 58 move along the grooves 26 and 16, the normal force on the inner cam rollers 56 varies to compensate for the increasing force exerted by the spring 70 to provide a constant torque acting on the inner and outer tubular member 20 and 16 and a constant force acting on the work surface 100B. Once the work surface 100B has reached the desired height, the user applies the brake 72 by pushing the pin 74 of the brake 72 into the inner tubular member 20.

Figure 22:
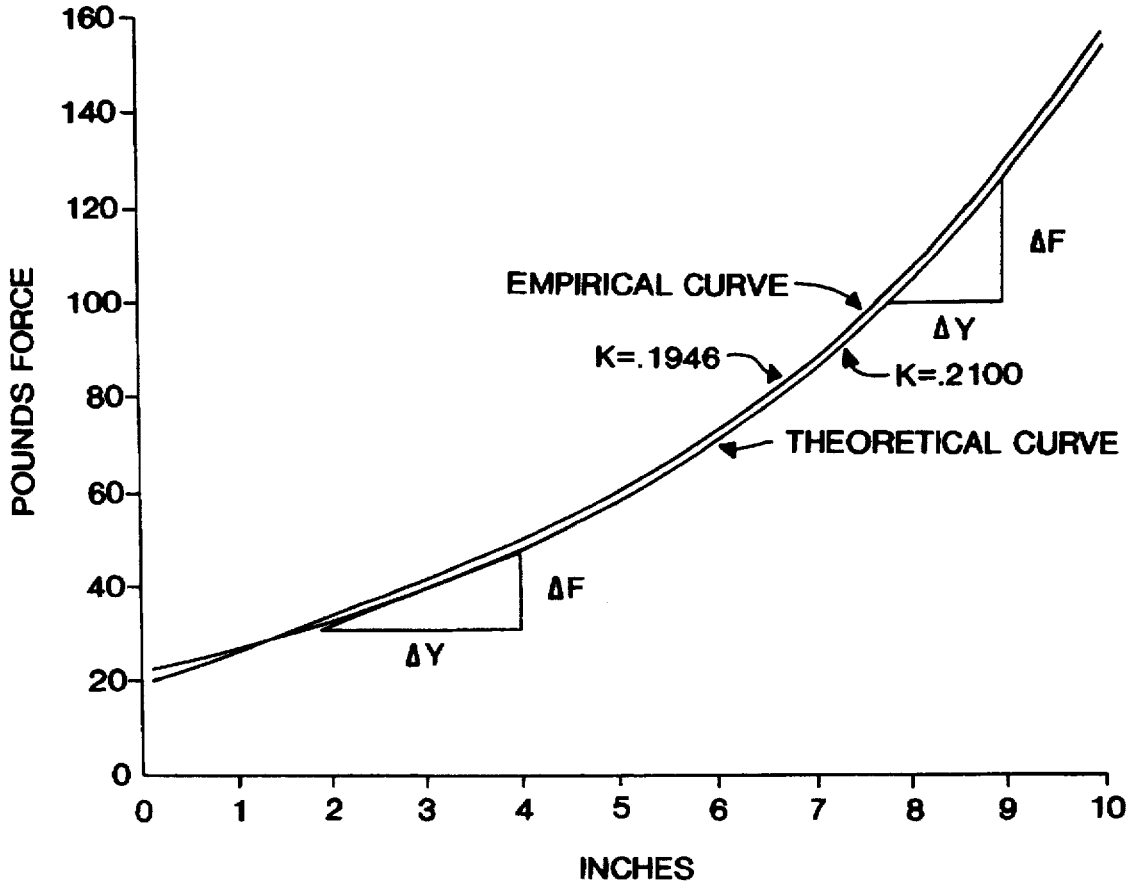
FIG. 22 is a graph of the empirical and theoretical curves of the force in pounds exerted by the spring (Y axis) versus the displacement in inches of the spring (X axis) where K=0.1946 for the empirical spring and K=0.2100 for theoretical spring.
Figure 23:
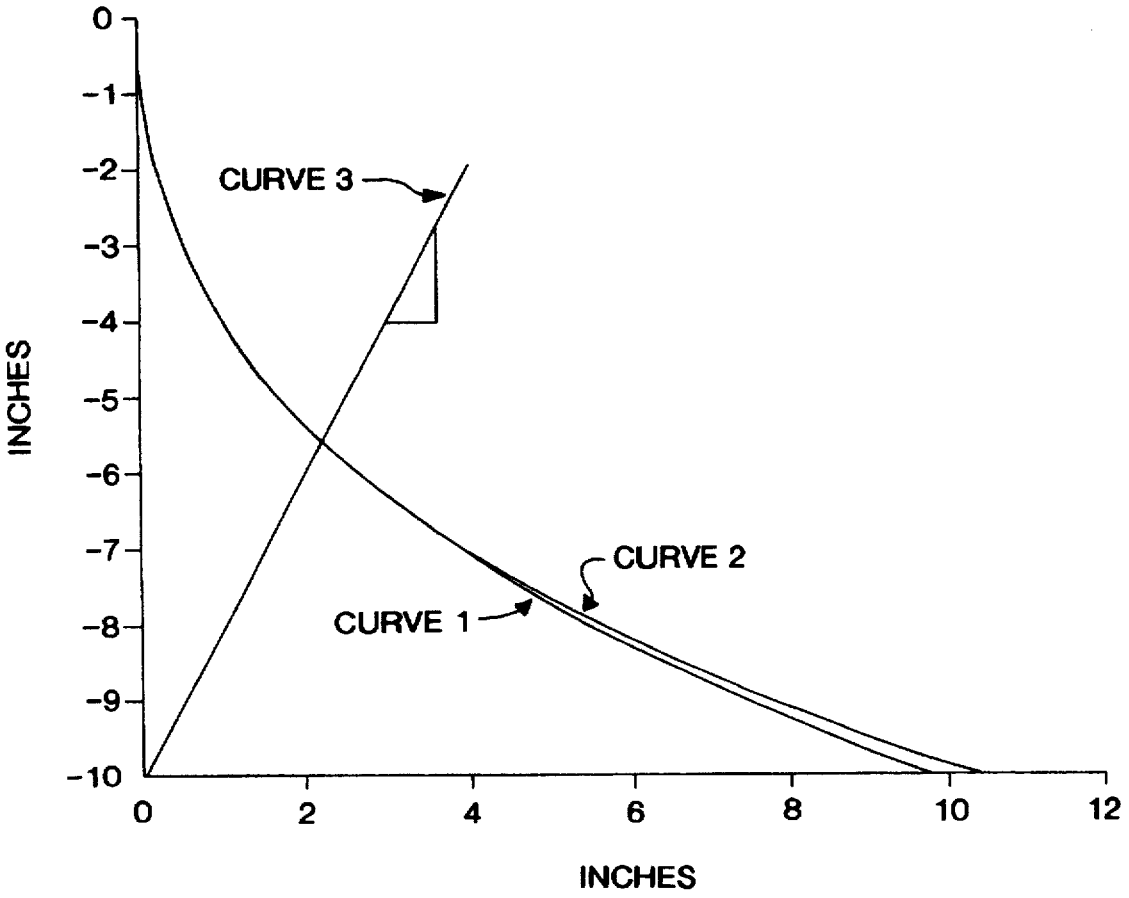
FIG. 23 is a graph of the empirical and theoretical axial displacement in inches of the inner cam rollers 56, 256, 356 or 456 along the longitudinal axis A—A of the apparatus 10, 210, 310 or 410 (Y axis) versus the total distance traveled in inches by the inner cam roller 56, 256, 356 or 456 along the inner cam grooves 26, 226, 326 or 426 (X axis) curves 1 and 2, respectively and the empirical, axial displacement in inches of the outer cam rollers 58, 258, 358 or 458 along the longitudinal axis A—A of the apparatus 10, 210, 310 or 410 (Y axis) versus the distance traveled in inches by the outer cam rollers 58, 258, 358 or 458 along the outer cam grooves 16, 216, 316 or 416 (X axis) curve 3.
Figure 24:
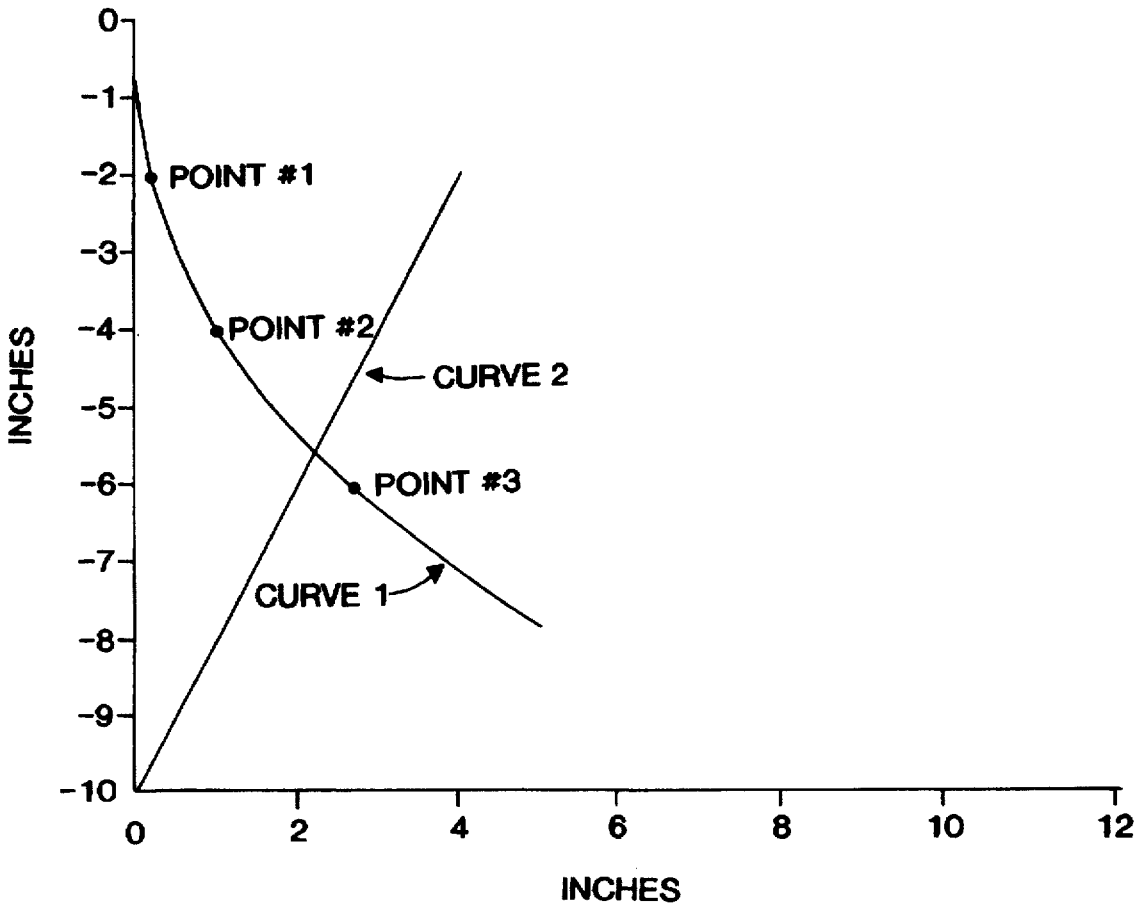
FIG. 24 is a graph of the empirical curves of the example showing the axial displacement in inches of the inner cam rollers 56 along the longitudinal axis A—A of the apparatus 10 (Y axis) versus the total distance traveled in inches by the inner cam rollers 56 along the inner cam grooves 26 (curve 1) and the axial displacement in inches of the outer cam rollers 58 along the longitudinal axis A—A of the apparatus 10 (Y-axis) versus the total distance traveled in inches by the outer cam rollers 58 along the outer cam grooves 16 (X axis) (curve 2).
Figure 25:
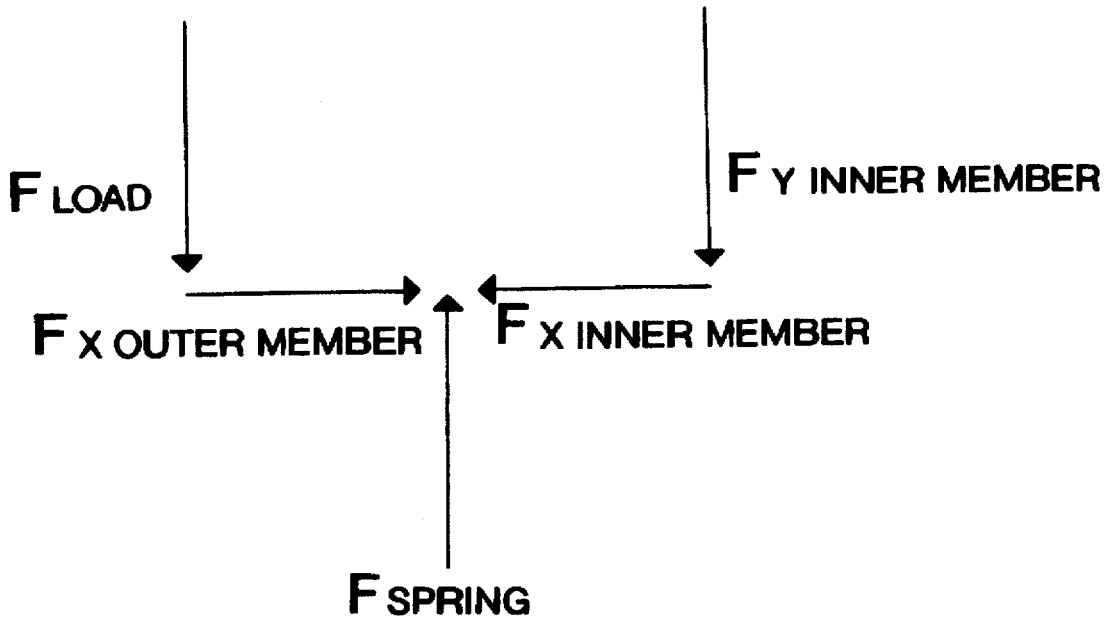
FIG. 25 is a vector diagram showing the forces acting on the points along the curve 1 of FIG. 24.

In one empirically calculated example of the apparatus 10, the preload force ($F_o$) is 22 lbs., which represents 1.33 inches (3.38 cm) compression of the spring 70 and the constant (K) defining the compound rate of change of the spring rate is preferably 0.1946 (FIGS. 22 and 24). In the specific example shown in FIGS. 24 and 25, the adjusted preload force is approximately 40 lbs. The inner cam grooves 26 preferably have an axial length of 7.1 inches (18.0 cm) and the outer cam grooves 16 preferably have an axial length of 7.9 inches (20.1 cm) with a uniform angle of 63.4° such that the slope (M) of the curve representing the outer cam grooves 16 is 2 (FIG. 23). The work surface 100B is preferably able to be moved a total distance of 15 inches (38.1 cm). The adjustment nut 44 is preferably able to be adjusted between 0.0 and 5.0 inches (0.0 and 12.7 cm) along the threaded rod 36 so as to compress the spring 70 up to 5.0 inches (12.7 cm) depending upon the amount of adjusted preload force required. Table 1 shows the force analysis calculations for the empirically derived example at three points along the curve representing the inner member 20 (FIG. 24).

TABLE 1

| | FLOAD | Fx outer member | FSPRING | FY inner member | FX inner member |
|---|---|---|---|---|---|
| Point #1 | 39.4 lbs | 78.8 lbs | 58.4 lbs | 19.0 lbs | 78.8 lbs |
| Point #2 | 38.1 lbs | 76.2 lbs | 85.0 lbs | 46.9 lbs | 76.2 lbs |
| Point #3 | 39.5 lbs | 79.0 lbs | 125.8 lbs | 86.3 lbs | 79.0 lbs |

FLOAD is the downward, adjusted preload force of the apparatus 10. Fx outer member is the force exerted by the outer member 16. Fy and Fx inner member are the forces exerted by the inner member 20. FSPRING is the upward force exerted by the spring. In this empirically calculated example, the force acting on the work surface 100B does not remain constant throughout movement of the work surface 100B (FIG. 24) but rather varies slightly.

In the second and third embodiments, the outer and inner cam grooves 216, 316 and 226, 326 are positioned differently but operate in a similar manner as in the first embodiment. The dampener 230 and 330 is able to pivot at the top end 232A and 332A to allow the cam follower 250 and 350 located at the bottom end 234A and 334A to move along the cam grooves 216, 316 and 226, 326 across the walls of the inner and outer members 212, 312 and 220, 320.

The apparatus 410 of the fourth embodiment works similarly to the apparatus 10 of the first embodiment. In the fourth embodiment, the cam grooves 416 and 426 on the middle tubular member 424 rotate along the rollers 456 and 458 mounted on the inner and outer tubular members 420 and 412. In the initial compressed position, with the work station 100 at the lowermost position, the inner tubular member 420 is almost fully within the outer tubular member 412 (FIG. 16). In addition, the middle tubular member 424 is completely within the outer tubular member 412 such that the bottom end 424B of the middle tubular member 424 is adjacent the bottom end 412B of the outer tubular member 412. As the work surface 100B is lifted upward, the inner tubular member 420 is lifted out of the outer tubular member 412. At the same time, the middle tubular member 424 moves up along the outer tubular member 412 toward the top end 412A of the outer tubular member 412. In the fully extended position, the inner tubular member 420 extends above the top of the outer tubular member 412 (FIG. 15). The middle tubular member 424 is preferably adjacent the top end 412A of the outer tubular member 412 such that the top end 424A of the middle tubular member 424 is flush with the top end 412A of the outer member 412.

It is intended that the foregoing description be only illustrative of the present invention and that the present invention be limited only by the hereinafter appended claims.

I claim:

1. In a counterbalance apparatus, the improvement which comprises:

(a) a first member defining a longitudinal axis and having a first end and a second end with at least one wall between the ends which forms the member;

(b) a second member slidably mounted in the first member so as to be along the axis and having a first end and a second end with at least one wall between the ends;

(c) first and second cam means, the first cam means for the first member and the second cam means for the second member, each of the cam means located on and between the second member and the first member, wherein the first and second cam means have cam surfaces which define oppositely inclined paths and cam followers which move in the oppositely inclined paths with respect to the longitudinal axis and wherein at least one of the second member or first member is movable along the longitudinal axis relative to the other of the members to move the members together; and (d) resilient means with opposed ends which are mounted between the second member and the first member so as to bias the members apart and wherein the resilient means becomes shorter in length between the ends when the members are moved together.

2. The counterbalance apparatus of claim 1 wherein the second and first members are each tubular and wherein the cam means are provided on and between the second and first members.

3. In a counterbalance apparatus, the improvement which comprises:

(a) a first tubular member defining a longitudinal axis and having a first end and a second end with at least one wall between the ends which forms the tubular member, wherein a first cam surface is provided on the wall and is inclined with respect to the longitudinal axis of the first tubular member;

(b) a second tubular member slidably mounted in the first tubular member so as to be along the axis and having a first end and a second end and at least one wall between the ends, wherein a second cam surface is provided on at least one wall of the second tubular member along the axis and is inclined with respect to the longitudinal axis of the first tubular member, wherein the first and second cam surfaces are oppositely inclined with respect to the longitudinal axis and wherein at least one of the second or first tubular members is movable along the longitudinal axis relative to the other of the tubular members to move the tubular members together;

(c) cam follower means mounted on and between the first and second cam surfaces, wherein the cam follower means moves on both cam surfaces simultaneously as the tubular members are moved together; and (d) resilient means with opposed ends which is mounted along and around the longitudinal axis of the tubular members so as to bias the tubular members apart and wherein the resilient means is shortened in length between the ends when the tubular members are moved together.

4. The counterbalance apparatus of claim 3 wherein the first and second cam surfaces are inclined so as to provide increasing leverage so that a relatively constant force can be applied between the ends of the tubular members which are distal to each other to move the tubular members together.

5. The counterbalance apparatus of any one of claims 3 or 4 wherein a dampening means having opposed ends is mounted at one end on one of the ends of the second tubular member with the cam follower means mounted at the other one of the ends of the dampening means.

6. The counterbalance apparatus of claim 5 wherein an adjustment means is mounted on the dampening means for varying a length of and thus compression of the resilient means mounted around the dampening means.

7. The counterbalance apparatus of claim 6 wherein the adjustment means is rotatable for compression and decompression of the resilient means and is provided by a rotatable, threaded member on the dampening means and a threaded retaining means mounted on the threaded member, the retaining means having a projection which engages a longitudinally oriented portion in at least one wall of the second tubular member.

8. The counterbalance apparatus of any one of claims 3 or 4 wherein a dampening means having opposed ends is mounted at one end on one of the ends of the second tubular member with the cam follower means mounted at the other end of the dampening means and wherein the resilient means is a coil spring means mounted inside of the second tubular member and around the dampening means so as to bias the tubular members apart.

9. The counterbalance apparatus of any one of claims 3 or 4 wherein a dampening means having opposed ends is mounted at one end on one of the ends of the second tubular member with the cam follower means mounted at the other end of the dampening means, wherein the resilient means is a coil spring means and is mounted inside of the second tubular member and around the dampening means so as to bias the tubular members apart and wherein the coil spring has non-linear coils along a length of the coil spring so as to require a variable force to compress the coil spring means along the length.

10. The counterbalance apparatus of any one of claims 3 or 4 wherein a dampening means having opposed ends is mounted at one end on one of the ends of the second tubular member with the cam follower means mounted at the other end of the dampening means and wherein an adjustment means is mounted on the dampening means for varying a length of and thus compression of the resilient means mounted between the end of the second tubular member and the cam follower means which biases the tubular members apart.

11. The counterbalance apparatus of any one of claims 3 or 4 wherein a dampening means having opposed ends is mounted at one end on one of the ends of the second tubular member with the cam follower means mounted at the other end of the dampening means, wherein the resilient means is a coil spring means and is mounted inside of the second tubular member and around the dampening means so as to bias the tubular members apart and wherein an adjustment means is mounted on the dampening means for varying a length and thus compression of the coil spring means when the tubular members are biased apart.

12. The counterbalance apparatus of any one of claims 3 or 4 wherein a dampening means having opposed ends is mounted at one end on one of the ends of the second tubular member with the cam follower means mounted at the other of the ends of the dampening means, wherein the resilient means is a coil spring means and is mounted inside of the second tubular member and around the dampening means so as to bias the tubular members apart and wherein the coil spring means has non-linear coils along a length of the coil spring so as to require a variable force to compress the coil spring along the length and wherein an adjustment means is mounted on the dampening means for varying the length of and thus compression of the coil spring means when the tubular members are biased apart.

13. The counterbalance apparatus of any one of claims 3 or 4 wherein a dampening means having opposed ends is mounted at one end on one of the ends of the second tubular member with the cam follower means mounted at the other of the ends of the dampening means wherein the resilient means is a coil spring means and is mounted inside of the second tubular member and around the dampening means to bias the tubular members apart and wherein an adjustment means is mounted on the dampening means for varying a length of and thus compression of the coil spring means when the tubular members are biased apart.

14. The counterbalance apparatus of any one of claims 3 or 4 wherein a dampening means having opposed ends is mounted at one of the ends on one of the ends of the second tubular member with the cam follower means mounted at the other one of the ends of the dampening means, wherein the resilient means is a coil spring means and is mounted inside of the second tubular member and around the dampening means so as to bias the tubular members apart and wherein a rotatable adjustment means for compression or decompression of the coil spring is provided by a threaded member on the dampening means and a threaded retaining means mounted on the threaded member, the threaded retaining means having a projection which movably engages a longitudinally oriented portion of at least one wall of the second tubular member.

15. The counterbalance apparatus of any one of claims 3 or 4 wherein a dampening means having opposed ends is mounted at one end on one of the ends of the second tubular member with the cam follower means mounted at the other end of the dampening means, wherein the resilient means is a coil spring means and is mounted inside of the second tubular member and around the dampening means so as to bias the tubular members apart, wherein the coil spring means has non-linear coils along a length of the coil spring means to require a variable force to compress the coil spring means along the length, wherein a rotatable adjustment means for compression or decompression of the coil spring means is mounted on the dampening means for varying the length of the coil spring means when the tubular members are biased apart, and wherein the adjustment means is provided by a threaded member on the dampening means and a threaded retaining means mounted on the threaded member, the threaded retaining means having a projection which movably engages a longitudinally oriented portion of at least one wall of the second tubular member.

16. The counterbalance apparatus of any one of claims 3 or 4 wherein a dampening means having opposed ends is mounted at one of the ends on one of the ends of the second tubular member with the cam follower means mounted at the other of the ends of the dampening means, and wherein the resilient means is a coil spring means and is mounted inside of the second tubular member and around the dampening means to bias the tubular members apart, wherein the coil spring means has non-linear coils along a length of the coil spring means so as to require a variable force to compress the coil spring means along the length, wherein a rotatable adjustment means for compression or decompression of the coil spring means is mounted on the dampening means for varying the length of the coil spring means when the tubular members are biased apart, wherein the adjustment means is provided by a threaded member on the dampening means and a threaded retaining means mounted on the threaded member, the threaded retaining means having a projection which engages a longitudinally oriented portion of at least one wall of the second tubular member and wherein the ends of the coil spring are mounted between the retaining means and the cam follower means.

17. The counterbalance apparatus of claims 3 or 4 wherein the second and first tubular members have a circular cross-section.

18. The counterbalance apparatus of claims 3 or 4 wherein the second and first members have a rectangular cross-section.

19. The apparatus of claims 3 or 4 wherein multiple of the first and second cam surfaces and the cam follower means are provided on the tubular members around the longitudinal axis.

20. The apparatus of claim 19 wherein there are three each of the first and second cam surfaces and the cam follower means.

21. The apparatus of claims 3 or 4 wherein a dampening means having opposed ends is mounted at one end on one of the ends of the second tubular member with the cam follower means mounted at the other end of the dampening means, and wherein the resilient means is a coil spring and is mounted inside of the second tubular member and around the dampening means to bias the tubular members apart, wherein the coil spring means has non-linear coils which require a variable force to compress the coil spring means along a length of the coil spring means, wherein a rotatable adjustment means for compression or decompression of the coil spring means is mounted on the dampening means for varying the length of the coil spring means when the tubular members are biased apart, and wherein the adjustment means is provided by a threaded member on the dampening means and a threaded retaining means mounted on the threaded member, the retaining means having a projection which engages the second tubular member, wherein the coil spring means has ends which are mounted between the retaining means and the cam follower means and wherein the second and first tubular members have a circular cross-section.

22. The apparatus of claims 3 or 4 wherein a dampening means having opposed ends is mounted at one end on one of the ends of the second tubular member with the cam follower means mounted at the other of the dampening means, and wherein the resilient means is a coil spring and is mounted inside of the second tubular member and around the dampening means to bias the tubular members apart, wherein the coil spring means has non-linear coils which require a variable force to compress the coil spring along a length of the coil spring, wherein an adjustment means for compression or decompression of the coil spring means is mounted on the dampening means for varying the length of the coil spring means when the tubular members are biased apart, and wherein the adjustment means is provided by a threaded member on the dampening means and a threaded retaining means mounted on the threaded member, the retaining means having a projection which engages the second tubular member, wherein the coil spring has ends which are mounted between the retaining means and the cam follower means and wherein the second and first tubular members have a rectangular cross-section.

23. A work station with a counterbalance movable work surface and a support means for the work surface of the work station with a counterbalance apparatus between the support means and the work surface of the work station for the movement which comprises:

(a) the counterbalance apparatus including a first member defining a longitudinal axis and having a first end and a second end with at least one wall between the ends which forms the member; a second member slidably mounted on the first member so as to be along the axis and having a first end and a second end with at least one wall between the ends; first and second cam means, the first cam means for the first member and the second cam means for the second member, each of the cam means located on and between the second member and the first member, wherein the first and second cam means have cam surfaces which define oppositely inclined paths and cam followers which move in the oppositely inclined paths with respect to the longitudinal axis and wherein at least one of the second member or first member is movable along the longitudinal axis relative to the other of the members to move the members together; and resilient means with opposed ends which are mounted in the second member to bias the members apart and wherein the resilient means becomes shorter in length between the ends when the members are moved together; and (b) locking means adjacent the counterbalance apparatus for securing the work surface of the work station against movement.

24. A work station with a counterbalance movable work surface and a support means for the work surface with a counterbalance apparatus between the support means and the work surface for the movement which comprises:

(a) the counterbalance apparatus including a first tubular member defining a longitudinal axis and having a first end and a second end with at least one wall between the ends which forms the tubular member, wherein a first cam surface is provided on the wall and is inclined with respect to the longitudinal axis of the first tubular member; a second tubular member slidably mounted in the first tubular member so as to be along the axis and having a first end and a second end and at least one wall between the ends, wherein a second cam surface is provided on the wall along the axis and is inclined with respect to the longitudinal axis of the first tubular member, wherein the first and second cam surfaces are oppositely inclined with respect to the longitudinal axis and wherein at least one of the second or first tubular members is movable along the longitudinal axis relative to the other of the tubular members to move the tubular members together; cam follower means mounted on and between the first and second cam surfaces, wherein the cam follower means moves on both cam surfaces simultaneously as the tubular members are moved together; and resilient means with opposed ends which are mounted along and around the longitudinal axis of the first tubular member so as to bias the tubular members apart and which is shortened in length between the ends of the resilient means when the tubular member are moved together; and (b) locking means for securing the work surface of the work station against movement.

25. In a counterbalance apparatus, the improvement which comprises:

(a) a first member defining a longitudinal axis and having a first end and a second end with at least one wall between the ends which forms the member;

(b) a second member slidably mounted on the first member so as to be along the axis and having a first end and a second end with at least one wall between the ends;

(c) first and second cam, the first cam for the first member and the second cam means for the second member, each of the cams located on and between the second member and the first member, wherein the first and second cam have cam surfaces which define oppositely inclined paths and cam followers which move in the oppositely inclined paths with respect to the longitudinal axis and wherein at least one of the second member or first member is movable along the longitudinal axis relative to the other of the members to move the members together; and (d) force storage mechanism with opposed ends which is mounted between the second member and the first member so as to bias the members apart.

26. In a counterbalance apparatus, the improvement which comprises:

(a) a first tubular member defining a longitudinal axis and having a first end and a second end with at least one wall between the ends which forms the tubular member, wherein a first cam surface is provided on at least one wall and is inclined with respect to the longitudinal axis of the first tubular member;

(b) a second tubular member slidably mounted in the first tubular member so as to be along the axis and having a first end and a second end and at least one wall between the ends, wherein a second cam surface is provided on at least one wall of the second tubular member along the axis and is inclined with respect to the longitudinal axis of the first tubular member, wherein the first and second cam surfaces are oppositely inclined with respect to the longitudinal axis and wherein at least one of the second or first tubular members is movable along the longitudinal axis relative to the other of the tubular members to move the tubular members together;

(c) cam follower mounted on and between the first and second cam surfaces, wherein the cam follower moves on both cam surfaces simultaneously as the tubular members are moved together; and (d) force storage mechanism with opposed ends which is mounted along and around the longitudinal axis of the tubular members so as to bias the tubular members apart.

27. The counterbalance apparatus of claim 26 wherein the first and second cam surfaces are inclined so as to provide increasing leverage so that a relatively constant force can be applied between the ends of the tubular members which are distal to each other to move the tubular members together.

28. The counterbalance apparatus of any one of claims 26 or 27 wherein a dampener having opposed ends is mounted at one end on one of the ends of the second tubular member with the cam follower mounted at the other one of the ends of the dampener.

29. The counterbalance apparatus of any one of claims 26 or 27 wherein a dampener having opposed ends is mounted at one end on one of the ends of the second tubular member with the cam follower mounted at the other end of the dampener and wherein the force storage mechanism is a coil spring mounted inside of the second tubular member and around the dampener so as to bias the tubular members apart.

30. The counterbalance apparatus of any one of claims 26 or 27 wherein a dampener having opposed ends is mounted at one end on one of the ends of the second tubular member with the cam follower mounted at the other end of the dampener, wherein the force storage mechanism is a coil spring and is mounted inside of the second tubular member and around the dampener so as to bias the tubular members apart and wherein the coil spring has non-linear coils along a length of the coil spring so as to require a variable force to compress the coil spring along the length.

31. The counterbalance apparatus of any one of claims 26 or 27 wherein an adjuster is mounted on the dampener for varying a length of and thus compression of the force storage mechanism mounted around the dampener.

32. The counterbalance apparatus of any one of claims 26 or 27 wherein a dampener having opposed ends is mounted at one end on one of the ends of the second tubular member with the cam follower mounted at the other end of the dampener and wherein an adjuster is mounted on the dampener for varying a length of and thus compression of the force storage mechanism mounted between the end of the second tubular member and the cam follower which biases the tubular members apart.

* * * * *